US011136861B2

(12) United States Patent
Williamson et al.

(10) Patent No.: US 11,136,861 B2
(45) Date of Patent: Oct. 5, 2021

(54) MECHANISMS FOR TRANSFERRING HYDRAULIC REGULATION FROM A PRIMARY SAFETY VALVE TO A SECONDARY SAFETY VALVE

(71) Applicant: Halliburton Energy Services, Inc., Houston, TX (US)

(72) Inventors: Jimmie Robert Williamson, Carrollton, TX (US); Glenn Ray Davis, Euless, TX (US); James Dan Vick, Jr., Dallas, TX (US); Robert Arthur Rademaker, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 138 days.

(21) Appl. No.: 15/777,189

(22) PCT Filed: Mar. 14, 2016

(86) PCT No.: PCT/US2016/022255

§ 371 (c)(1),
(2) Date: May 17, 2018

(87) PCT Pub. No.: WO2017/160264

PCT Pub. Date: Sep. 21, 2017

(65) Prior Publication Data

US 2018/0355698 A1 Dec. 13, 2018

(51) Int. Cl.
*E21B 34/16* (2006.01)
*E21B 34/14* (2006.01)

(52) U.S. Cl.
CPC ..... *E21B 34/16* (2013.01); *E21B 34/14* (2013.01); *E21B 2200/05* (2020.05); *E21B 2200/06* (2020.05)

(58) Field of Classification Search
CPC .... E21B 34/16; E21B 34/14; E21B 2034/007; E21B 2034/005; E21B 34/06;
(Continued)

(56) References Cited

U.S. PATENT DOCUMENTS 3,763,932 A * 10/1973 Dinning ..... E21B 34/106 166/72
3,799,258 A * 3/1974 Tausch ..... E21B 34/106 166/72
(Continued)

FOREIGN PATENT DOCUMENTS

WO WO-2008/002473 A2 1/2008
WO WO-2011/072121 A2 6/2011
(Continued)

OTHER PUBLICATIONS

Halliburton, "Subsurface Flow Control Systems," retrieved from http://www.halliburton.com/public/cps/contents/Books_and_Catalogs/web/CPSCatalog/08_SSFC.pdf, not dated, 68 pages.
(Continued)

*Primary Examiner* — Michael R Wills, III
(74) *Attorney, Agent, or Firm* — McGuireWoods LLP

(57) ABSTRACT

Wellbore systems containing a hydraulically regulated primary safety valve may have their hydraulic regulation transferred to an insert safety valve disposed in a nipple. Transfer of the hydraulic regulation may take place mechanically, such as through axial displacement of a sliding sleeve or by replacement of a hydraulic spool. Wellbore systems configured for axial displacement of a switching mechanism may comprise: a tubing string comprising a nipple and a primary safety valve, the primary safety valve being disposed in the tubing string above or below the nipple; a control line and a balance line in hydraulic communication with the primary safety valve and in latent hydraulic communication with an internal flow pathway
(Continued)

within the nipple; and a switching mechanism that is axially displaceable to establish hydraulic communication between an insert safety valve positioned in a bore of the nipple and both the control line and the balance line.

20 Claims, 18 Drawing Sheets

(58) Field of Classification Search
CPC .. E21B 17/18; E21B 2034/002; E21B 34/105; E21B 2034/106
See application file for complete search history.

(56) References Cited

U.S. PATENT DOCUMENTS 3,865,141 A 2/1975 Young
3,882,935 A * 5/1975 Calhoun ..... E21B 34/106 166/322
4,193,450 A 3/1980 Fisher, Jr.
4,273,186 A * 6/1981 Pearce ..... E21B 34/106 166/72
4,460,046 A * 7/1984 Pringle ..... E21B 34/106 137/68.16
4,524,830 A 6/1985 Williams
4,534,414 A 8/1985 Pringle
4,566,540 A * 1/1986 Pringle ..... E21B 34/106 166/317
4,605,070 A 8/1986 Morris
4,621,695 A 11/1986 Pringle
RE32,343 E 2/1987 Vinzant et al.
4,667,736 A 5/1987 Rumbaugh et al.
4,854,387 A 8/1989 Pringle
5,170,845 A 12/1992 Gay et al.
5,205,355 A 4/1993 Gay et al.
5,226,483 A 7/1993 Williamson, Jr.
6,003,605 A 12/1999 Dickson et al.
6,298,919 B1 * 10/2001 Browne ..... E21B 23/04 166/373
6,491,106 B1 12/2002 Simonds
7,392,849 B2 7/2008 Lauderdale et al.
7,637,324 B2 12/2009 Anderson et al.
8,281,865 B2 10/2012 Joseph et al.
9,739,116 B2 * 8/2017 Kirkpatrick ..... E21B 34/00
9,810,039 B2 * 11/2017 Vick, Jr. ..... F16K 1/2007
10,513,908 B2 * 12/2019 Scott ..... E21B 34/106
2003/0230190 A1 12/2003 Douglas
2007/0068680 A1 3/2007 Vick
2009/0205831 A1 8/2009 Jacob
2009/0229834 A1 9/2009 Bolding et al.
2009/0294135 A1 12/2009 Jacob et al.
2009/0294136 A1 12/2009 Jones et al.
2010/0059682 A1 3/2010 Conti
2011/0132614 A1 * 6/2011 Garr ..... E21B 23/02 166/321
2011/0139437 A1 * 6/2011 Garr ..... E21B 34/105 166/217
2012/0073829 A1 3/2012 Smith et al.
2013/0056222 A1 3/2013 Smith et al.
2013/0092396 A1 * 4/2013 Webber ..... E21B 34/10 166/375
2015/0211333 A1 * 7/2015 Vick, Jr. ..... E21B 34/066 166/375
2015/0354316 A1 * 12/2015 Kirkpatrick ..... E21B 34/10 166/375
2016/0108701 A1 * 4/2016 Lake ..... E21B 34/08 166/374
2018/0202261 A1 * 7/2018 Scott ..... E21B 34/16
2018/0371870 A1 * 12/2018 Pickle ..... E21B 34/063

FOREIGN PATENT DOCUMENTS

WO 2014189494 A1 11/2014
WO 2015188080 A1 12/2015

OTHER PUBLICATIONS

Halliburton, "Subsurface Safety Equipment," retrieved from http://www.halliburton.com/public/cps/contents/Books_and_Catalogs/web/CPSCatalog/09_Subsurface_Safety_Equip.pdf, not dated ,40 pages.
International Search Report and Written Opinion from PCT/US2016/022255, dated Dec. 13, 2016, 20 pages.
European Search Report dated Mar. 18, 2020; European Application No. 16894723.2.

* cited by examiner

MECHANISMS FOR TRANSFERRING HYDRAULIC REGULATION FROM A PRIMARY SAFETY VALVE TO A SECONDARY SAFETY VALVE

BACKGROUND

The present disclosure generally relates to subterranean wellbore operations and equipment and, more specifically, to mechanisms for transferring hydraulic regulation from a primary safety valve to an insert safety valve.

Subsurface safety valves (SSSVs) are well known in the oil and gas industry and provide one of many failsafe mechanisms to prevent the uncontrolled release of wellbore fluids should a wellbore system experience a loss in containment. Typically, subsurface safety valves comprise a portion of a tubing string set in place during completion of a wellbore. Although a number of design variations are possible for subsurface safety valves, the vast majority are flapper-type valves that open and close in response to longitudinal movement of a flow tube. Since subsurface safety valves provide a failsafe mechanism, the default positioning of the flapper valve is usually closed in order to minimize the potential for inadvertent release of wellbore fluids. The flapper valve can be opened through various means of control from the earth's surface in order to provide a flow pathway for production to occur.

In many instances, the flow tube can be regulated from the earth's surface using a piston and rod assembly that may be hydraulically charged via a control line linked to a hydraulic manifold or control panel. The term "control line" will be used herein to refer to a hydraulic line configured to displace the flow tube of a subsurface safety valve downward upon pressurization, or otherwise to become further removed from the exit of a wellbore. When sufficient hydraulic pressure is conveyed to a subsurface safety valve via the control line, the piston and rod assembly forces the flow tube downward, which causes the flapper valve to move into its open position upon. When the hydraulic pressure is removed from the control line, the flapper valve can return to its default, closed position using a biasing spring and/or downhole pressure. A self-closing mechanism, such as a torsion spring, can also be present to promote closure of the flapper valve should a loss of hydraulic pressure occur.

Some subsurface safety valves can also employ a second hydraulic line configured to counterbalance the effects of the control line and to provide an additional means of regulating the flow tube. The term "balance line" will be used herein to refer to a hydraulic line configured to displace the flow tube of a subsurface safety valve upward upon pressurization, or otherwise to become less removed from the exit of a wellbore. A balance line, when present, can operate in a similar manner to a control line and can also be controlled from the earth's surface. Accordingly, the terms "control line" and "balance line" can alternately be defined in terms of the propensity of these lines toward keeping a subsurface safety valve open or closed when pressurized. That is, a pressurized control line tends to force a subsurface safety valve toward an open position, whereas a pressurized balance line tends to force a subsurface safety valve toward a closed position. A balance line can also reduce section pressure acting on a piston by reducing the pressure differential.

Depending on operational considerations, a subsurface safety valve may be placed hundreds to thousands of feet downhole. During downhole placement of a subsurface safety valve, numerous opportunities exist for inadvertent damage to occur to the control line and/or the balance line, including line severance, thereby rendering the line(s) inoperative for regulating the subsurface safety valve. Line damage can also occur after a subsurface safety valve has been set in place and is in operational use. In addition to issues associated with the control line and/or the balance line, subsurface safety valves themselves may become damaged due to corrosion or scaling and no longer function properly. In the event of hydraulic failure or related damage to a subsurface safety valve, very expensive and time-consuming workover operations may be needed to replace the non-functioning valve.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

The present disclosure generally relates to subterranean wellbore operations and equipment and, more specifically, to mechanisms for transferring hydraulic regulation from a primary safety valve to an insert safety valve.

One or more illustrative embodiments incorporating the features of the present disclosure are presented herein. Not all features of a physical implementation are necessarily described or shown in this application for the sake of clarity. It is to be understood that in the development of a physical implementation incorporating the embodiments of the present disclosure, numerous implementation-specific decisions may be made to achieve the developer's goals, such as compliance with system-related, business-related, government-related and other constraints, which may vary by implementation and from time to time. While a developer's efforts might be time-consuming, such efforts would be, nevertheless, a routine undertaking for one having ordinary skill in the art and the benefit of this disclosure.

In the description herein, directional terms such as "above", "below", "upper", "lower", and the like, are used for convenience in referring to the accompanying drawings. In general, "above", "upper", "upward" and similar terms refer to a direction toward the exit of a wellbore, often toward the earth's surface, and "below", "lower", "downward" and similar terms refer to a direction away from the exit of a wellbore, often away from the earth's surface.

Figure 1:
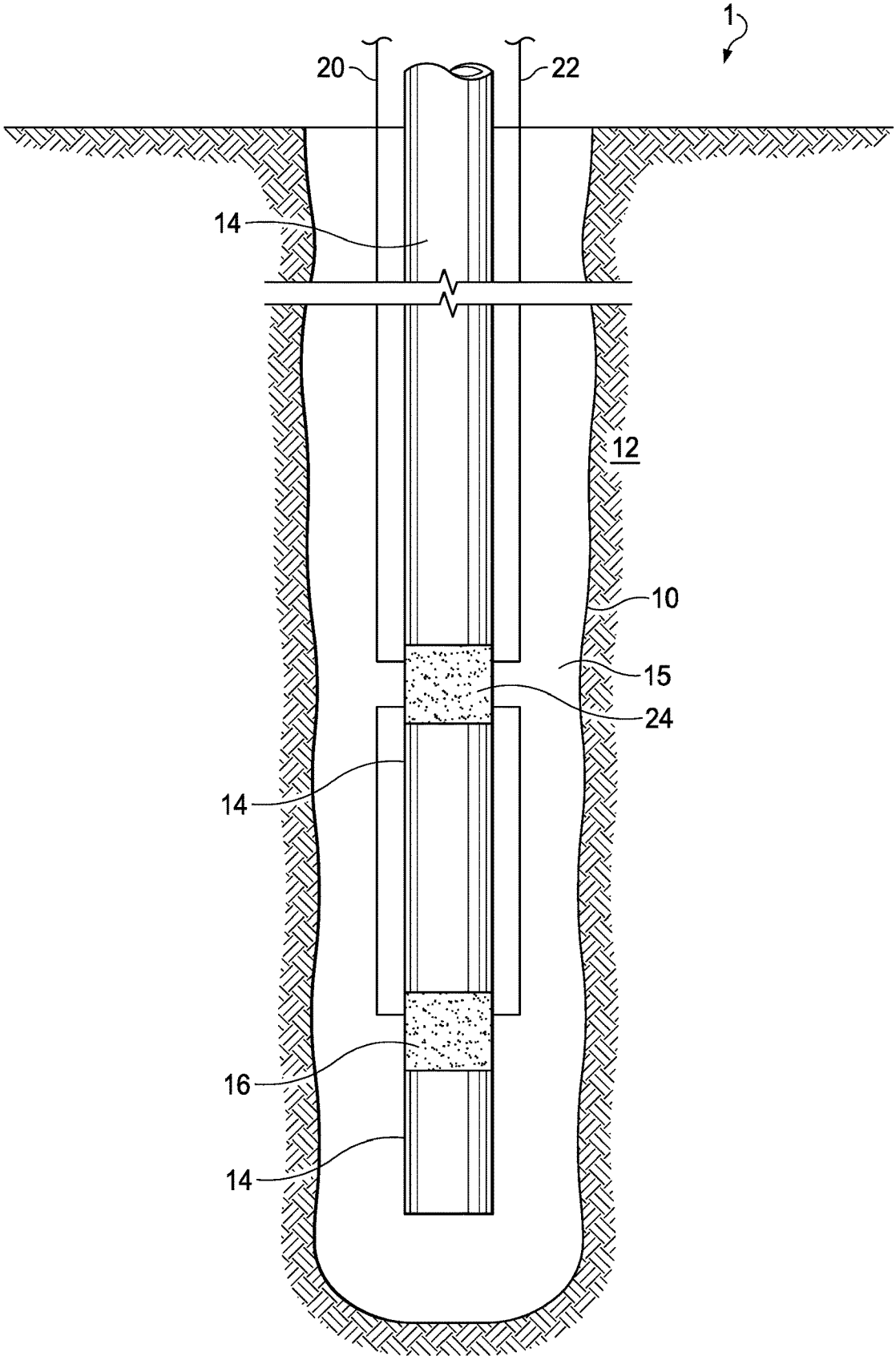
FIG. 1 shows an illustrative schematic of a wellbore system containing a tubing string having a nipple and a tubing-retrievable safety valve attached thereto.

FIG. 1 shows an illustrative schematic of a wellbore system containing a tubing string having a nipple and a tubing-retrievable safety valve attached thereto. The tubing-retrievable safety valve may represent a primary safety valve of the wellbore system. The terms "tubing-retrievable safety valve," "primary safety valve," and "safety valve" are synonymous and may be used interchangeably herein. In wellbore system 1, wellbore 10 penetrates subterranean formation 12. Although wellbore 10 is depicted as being substantially vertical in FIG. 1, it is to be recognized that one or more non-vertical sections may also be present and are fully consistent with the embodiments of the present disclosure. Tubing string 14 is disposed within at least a portion of the length of wellbore 10, with annulus 15 being defined between the exterior of tubing string 14 and the interior of wellbore 10. Tubing string 14 further defines an internal flow pathway therethrough (not shown in FIG. 1). Safety valve 16 is interconnected to tubing string 14 and is configured to regulate fluid flow above and below safety valve 16 within the internal flow pathway, including shutting off fluid access in the event of an emergency. Safety valve 16 may have at least one hydraulic line connected thereto (two shown in FIG. 1, e.g., control line 20 and balance line 22), as discussed in more detail below. Control line 20 and balance line 22 may extend from the earth's surface in order to allow operation of safety valve 16 to take place from a rig, wellhead installation, or subsea platform located on the earth's surface or the ocean's surface. Nipple 24 may also be arranged within an upper portion of tubing string 14, or nipple 24 may be integral with safety valve 16. An insert safety valve may be positioned in nipple 24 and actuated, as discussed in further detail below.

Figure 2A:
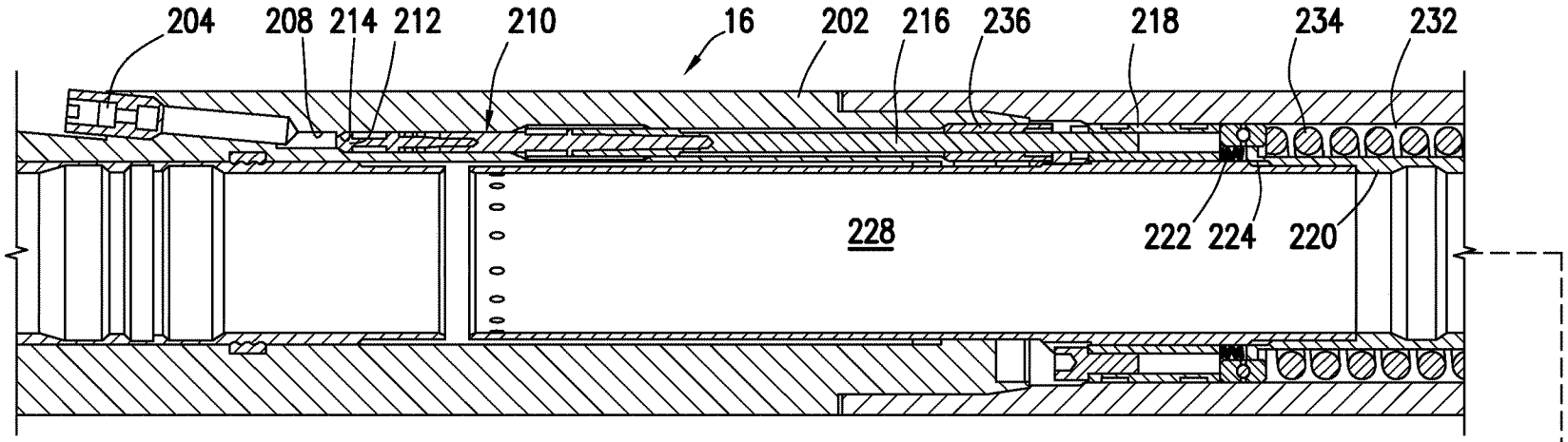
FIGS. 2A and 2B show detailed schematics of an illustrative tubing-retrievable safety valve that is operable by a single hydraulic control line.
Figure 2B:
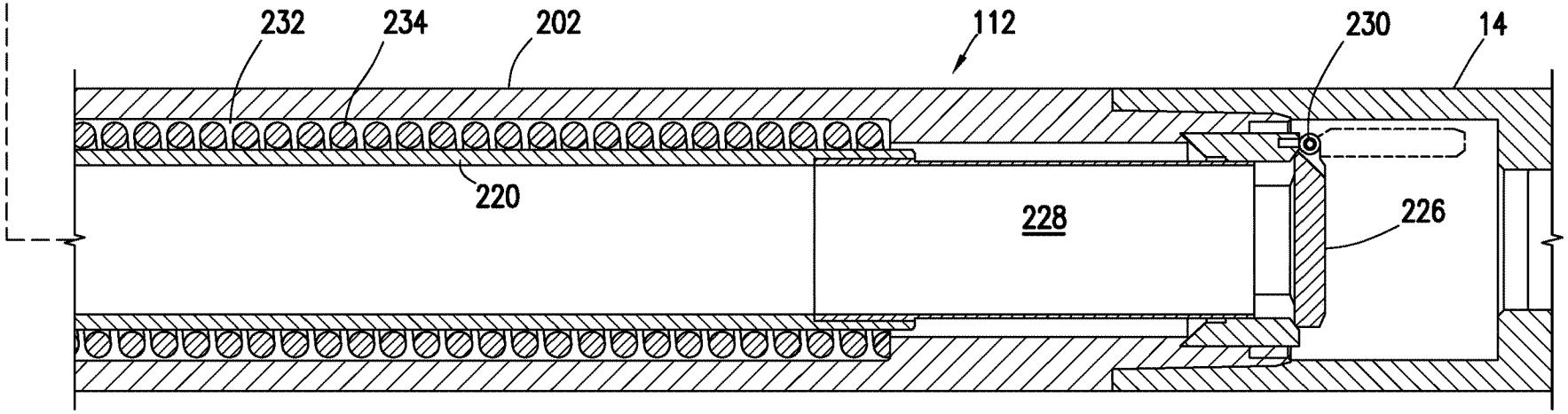

FIGS. 2A and 2B show detailed schematics of an illustrative tubing-retrievable safety valve that is operable by a single hydraulic control line. With continued reference to FIG. 1, FIGS. 2A and 2B show progressive cross-sectional side views of illustrative safety valve 16 and its hydraulic operating mechanisms. FIG. 2A depicts an upper portion of safety valve 16 and FIG. 2B depicts a successive lower portion of safety valve 16. Safety valve 16 includes housing 202 that is coupled to tubing string 14 at opposing ends of housing 202 (tubing string 14 shown only in FIG. 2B). It is to be recognized that safety valve 16 depicted in FIGS. 2A and 2B is merely illustrative of many possible configuration for a hydraulically operated safety valve. Hence, other safety valves may operate using similar principles, and the depicted valve configuration should not be considered limiting.

Control line port 204 may be provided in housing 202 for connecting a hydraulic control line (not shown in FIG. 2A or 2B) to safety valve 16. When appropriately connected to control line port 204, the hydraulic control line establishes fluid communication with piston bore 208 defined in housing 202, thereby allowing hydraulic fluid pressure to be conveyed thereto. Piston bore 208 may be an elongate channel or conduit that extends substantially longitudinally along a portion of the axial length of safety valve 16.

Piston assembly 210 is arranged within piston bore 208 and is configured to translate axially therein. Piston assembly 210 includes piston head 212 that mates with and otherwise biases up stop 214 defined within piston bore 208 when piston assembly 210 is forced upwards. Up stop 214 may be a radial shoulder defined by housing 202 within piston bore 208, which has a reduced diameter and an axial surface configured to engage a corresponding axial surface of piston head 212. Up stop 214 may generate a mechanical metal-to-metal seal between the two components to prevent the migration of fluids (e.g., hydraulic fluids, production fluids, and the like) therethrough. Other configurations of up stop 214 that are configured to arrest axial movement of piston assembly 210 are also possible.

Piston assembly 210 may also include piston rod 216 that extends longitudinally from piston assembly 210 through at least a portion of piston bore 208. At a distal end of piston rod 216, it may be coupled to actuator sleeve 218 for affecting motion of flow tube 220. Flow tube 220 is movably arranged within safety valve 16. More particularly, actuator sleeve 218 may engage biasing device 222 (e.g., a compression spring, a series of Belleville washers, or the like) arranged axially between actuator sleeve 218 and actuation flange 224 that forms part of the proximal end of flow tube 220. As actuator sleeve 218 acts upon biasing device 222 with axial force, actuation flange 224 and flow tube 220 correspondingly move axially in the direction of the applied force (i.e., downward with increasing hydraulic pressure). Down stop 236 may be arranged within the piston bore 208 in order to limit the range of axial motion of piston assembly 210. A metal-to-metal seal may be created between piston assembly 210 and down stop 236 such that the migration of fluids (e.g., hydraulic fluids, production fluids, and the like) therethrough is generally prevented.

Safety valve 16 further includes flapper valve 226 that is selectively movable between open and closed positions to either prevent or allow fluid flow through internal flow pathway 228 defined through the interior of safety valve 16. Flapper valve 226 is shown in FIG. 2B in its default, closed position such that fluid flow into internal flow pathway 228 from downhole (i.e., to the right of FIG. 2B) is substantially blocked. At least one torsion spring 230 biases flapper valve 226 to pivot to its closed position.

Upon hydraulic pressurization and downward movement of piston rod 216, flow tube 220 is also displaced downward, eventually overcoming the force associated with torsion spring 230 and any associated downhole fluid pressures. At this point, flapper valve 226 moves from its closed position to an open position (shown in phantom in FIG. 2B). When the hydraulic pressure is released, flow tube 220 is displaced upwardly and the spring force of torsion spring 230 moves flapper valve 226 back to its closed position.

Safety valve 16 may further contain lower chamber 232 within housing 202. In some embodiments, lower chamber 232 may form part of piston bore 208, such as being an elongate extension thereof. Power spring 234, such as a coil or compression spring, may be arranged within lower chamber 232 and correspondingly biases actuation flange 224 and actuation sleeve 218 upwardly, which, in turn, also biases piston assembly 210 in the same direction. That is, power spring 234 also resists the hydraulic pressure applied from the hydraulic control line and helps to prevent flapper valve 226 from being opened inadvertently. Accordingly, expansion of the power spring 234 causes piston assembly 210 to move upwardly within piston bore 208. It should be noted that in addition to power spring 234, other types of biasing devices, such as a compressed gas with appropriate sealing mechanisms, may be employed similarly.

As mentioned above, a hydraulic line may provide hydraulic pressurization to safety valve 16 at control line port 204. However, more than one hydraulic line may be present in certain types of safety valves. For example, referring again to FIG. 1, safety valve 16 may be controllable by dual hydraulic lines, such as control line 20 and balance line 22. The DEPTHSTAR® tubing-retrievable safety valve from Halliburton Energy Services, Inc. is one illustrative example of a safety valve that is controllable by dual hydraulic lines. Control line 20 may provide for hydraulic pressurization of safety valve 16 in a manner similar to that described above in reference to FIGS. 2A and 2B. That is, hydraulic pressurization of control line 20 may force a flow tube downward to open safety valve 16. In contrast, hydraulic pressurization of balance line 22 may tend to force the flow tube upwardly. That is, balance line 22 counteracts the hydraulic pressurization provided by control line 20 and further supplements the upward forces tending to keep safety valve 16 closed. Similarly, balance line 22 can reduce the section pressure by reducing a pressure differential acting on the flow tube. Other mechanisms for actuating safety valve 16 through pressurization of control line 20 and balance line 22 can also be envisioned by one having ordinary skill in the art.

As depicted in FIG. 1, control line 20 and balance line 22 extend to safety valve 16 within annulus 15, in close proximity to tubing string 14. However, other configurations for control line 20 and balance line 22 are also possible. In alternative configurations, for instance, control line 20 and/or balance line 22 may be located in the internal flow pathway of tubing string 14 or be defined, at least in part, in a sidewall of tubing string 14 or a component thereof (e.g., within the sidewall of nipple 24 or an associated sub). Regardless of their particular configurations, control line 20 and balance line 22 allow safety valve 16 to be controlled hydraulically from the earth's surface.

As discussed above, failure of control line 20 or balance line 22 can render safety valve 16 at least partially inoperable. Failure of control line 20 can be particularly detrimental, since failure of this line can lead to an inability to maintain safety valve 16 in an open position. Similarly, failure of safety valve 16 itself (e.g., due to corrosion or scaling) may prevent effective hydraulic control from taking place. To address the foregoing issues that may arise when safety valve 16 has become inoperable, hydraulic communication with safety valve 16 may be discontinued and transferred to an insert (secondary) safety valve located above safety valve 16 within tubing string 14, as discussed herein. Specifically, the insert safety valve may be placed or inserted in tubing string 14 within the internal flow pathway (bore) of nipple 24, particularly after safety valve 16 has failed. In alternative embodiments, the insert safety valve may be placed in tubing string 14 below safety valve 16. Accordingly, the term "insert safety valve" will be used herein to refer to a secondary safety valve that is used to replace or otherwise supplement an inoperative primary safety valve 16. The terms "insert safety valve" and "secondary safety valve" may be used interchangeably herein. Insert safety valves are not considered to be a redundant backup of the primary safety valve 16, but are instead placed in-line in response to a failed primary safety valve 16 to supplant its operation. Effective replacement of a primary safety valve 16 with an insert safety valve can allow production of wellbore fluids to continue without conducting an expensive and time-consuming workover operation to withdraw tubing string 14 for valve repair or exchange. Safety valve 16 and the insert safety valve contained within nipple 24 may be separated by any distance, which may range from inches to thousands of feet.

Various mechanisms for affecting hydraulic control of an insert safety valve, particularly an insert safety valve that is controllable by dual hydraulic lines, are discussed further herein. Advantageously, the disclosure herein allows an existing control line 20 and an existing balance line 22 to be used for regulating the insert safety valve, rather than deploying one or more new lines and increasing the number of penetrations through a tubing hanger. Further, the disclosure herein provides for discontinuing hydraulic communication with safety valve 16 in the course of re-establishing it with the insert safety valve. That is, the disclosure herein allows the lower portions (i.e., the initially operative portions) of control line 20 and balance line 22 to be shut off so that hydraulic communication with safety valve 16 no longer takes place. In the case of an insert safety valve placed below safety valve 16, the term "lower portion" no longer directly corresponds to the geometric disposition of the line being shut off. Accordingly, the terms "initially operative portion" or "primary portion" will refer herein to the portion of a hydraulic line initially being used to regulate safety valve 16, regardless of the geometric disposition of the line. Alternately, the term "lower portion" will refer herein to the portion of control line 20 or balance line 22 initially used to regulate safety valve 16 before subsequently being shut off, regardless of the geometric disposition of the line.

With reference again being made to FIG. 1, an insert safety valve may be positioned in an internal flow pathway (not shown in FIG. 1) defined within nipple 24, which comprises a portion of tubing string 14 above safety valve 16. Nipple 24 may also be located below safety valve 16 for similar reasons to those discussed above, or dual nipples may also be provided above and below safety valve 16, where the dual nipples serve different functions. With continued reference being made to FIG. 1, a portion of the internal flow pathway may comprise the bore of nipple 24 and any profile features defined therein. The profile features within the bore may allow the insert safety valve to be properly seated, sealed and retained therein. For example, nipple 24 may comprise a landing shoulder or threading within the bore to ensure proper seating of the insert safety valve. Properly locating the insert safety valve within the bore may help to establish hydraulic communication with control line 20 and balance line 22. Appropriate sealing may also be provided about the insert safety valve in order to isolate the hydraulic fluids traveling thereto from control line 20 and balance line 22, thereby allowing these lines to exert independent hydraulic control of the insert safety valve.

According to various embodiments of the present disclosure, mechanical switching of the hydraulic flow pathways defined by control line 20 and balance line 22 may redirect their hydraulic communication from safety valve 16 to the bore of nipple 24, thereby allowing hydraulic regulation of an insert safety valve to take place. The mechanical switching may take place within nipple 24 itself or within a sub that is separate from nipple 24. Upon mechanical switching the hydraulic communication from control line 20 and balance line 22 to the bore of nipple 24, hydraulic regulation of safety valve 16 is discontinued in favor of an insert safety valve within nipple 24. Specifically, the embodiments of the present disclosure allow the insert safety valve to be regulated hydraulically with control line 20 and balance line 22 following mechanical switching of these lines. That is, opening and closing of the insert safety valve may take place through appropriately pressurizing and de-pressurizing control line 20 and balance line 22. Advantageously, the embodiments of the present disclosure allow both control line 20 and balance line 22 to be switched for operating the insert safety valve, thereby maintaining the desirable features afforded by dual hydraulic lines in operating safety valve 16. Various configurations for affecting mechanical switching of these lines are described in more detail hereinafter. In order for hydraulic regulation of an insert safety valve to take place, control line 20 and balance line 22 are placed in latent hydraulic communication with the internal flow pathway of nipple 24 (latent hydraulic communication and internal flow pathway not shown in FIG. 1). As used herein, the term "latent hydraulic communication" will refer to a portion of a hydraulic flow pathway that does not undergo hydraulic pressurization until a triggering event occurs to change the configuration of the flow pathway. In the various embodiments described herein, the triggering event involves a mechanical switching action, as described in further detail below.

In order to facilitate latent hydraulic communication within nipple 24, control line 20 and balance line 22 may be coupled with corresponding ports defined on the exterior of nipple 24 and/or at least a portion of these lines may be defined within the sidewall of nipple 24. Under normal operational conditions (i.e., when safety valve 16 is still functional), hydraulic pressurization actuates safety valve 16 and bypasses the locations where latent hydraulic communication is later established. Hydraulic fluid may pass through nipple 24 in performing this action, but without accessing the portions of these lines that are in latent hydraulic communication with the bore of nipple 24. Accordingly, the embodiments of the present disclosure describe various configurations in which the lower portions (i.e., initially active portions) of control line 20 and balance line 22, each leading to safety valve 16, may be bypassed following activation of the hydraulic lines establishing latent hydraulic communication within nipple 24.

Figure 3A:
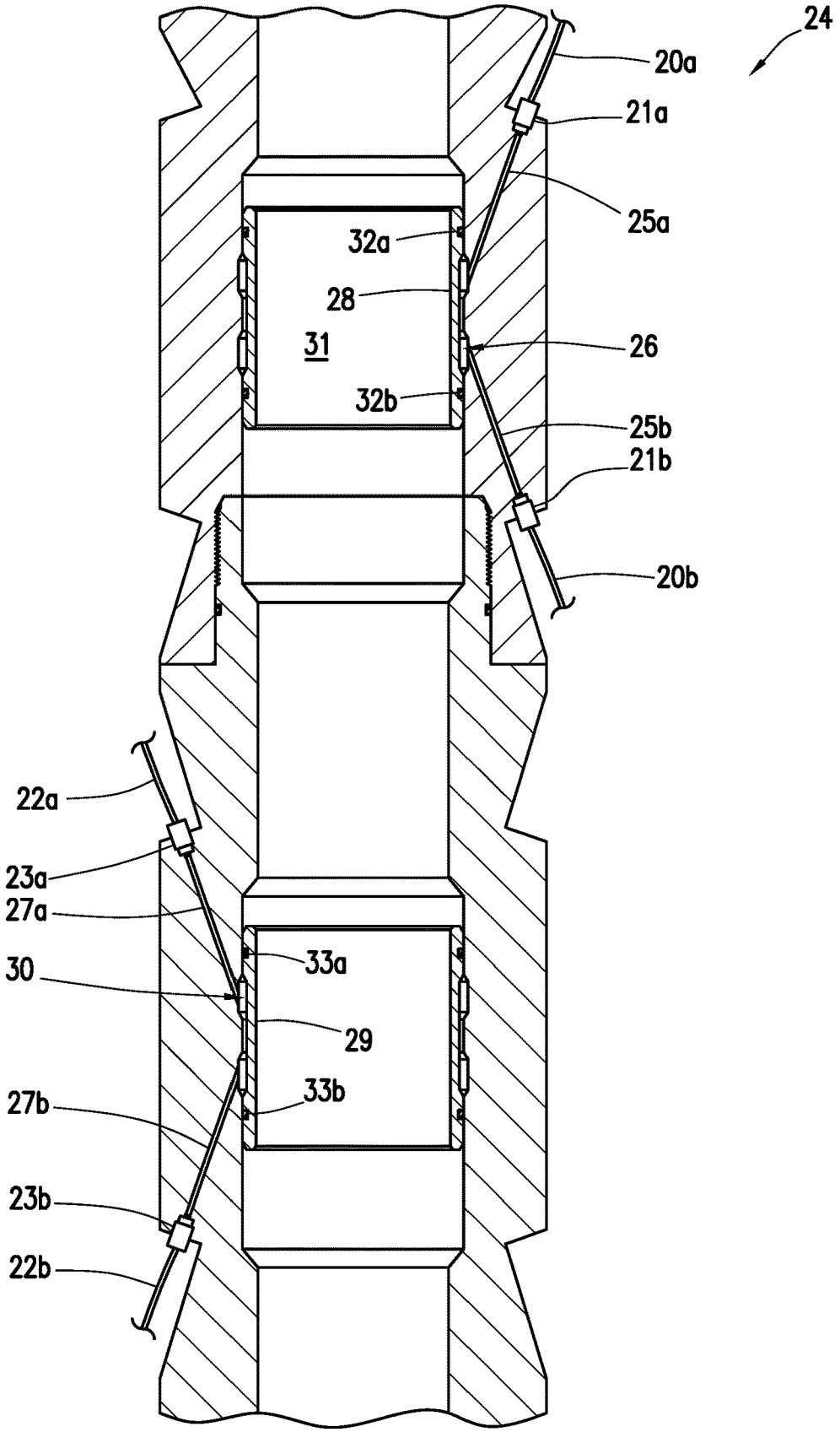
FIGS. 3A-3C show schematics of an illustrative nipple configuration in which dual sliding sleeves may affect switching of a control line and a balance line.
Figure 3B:
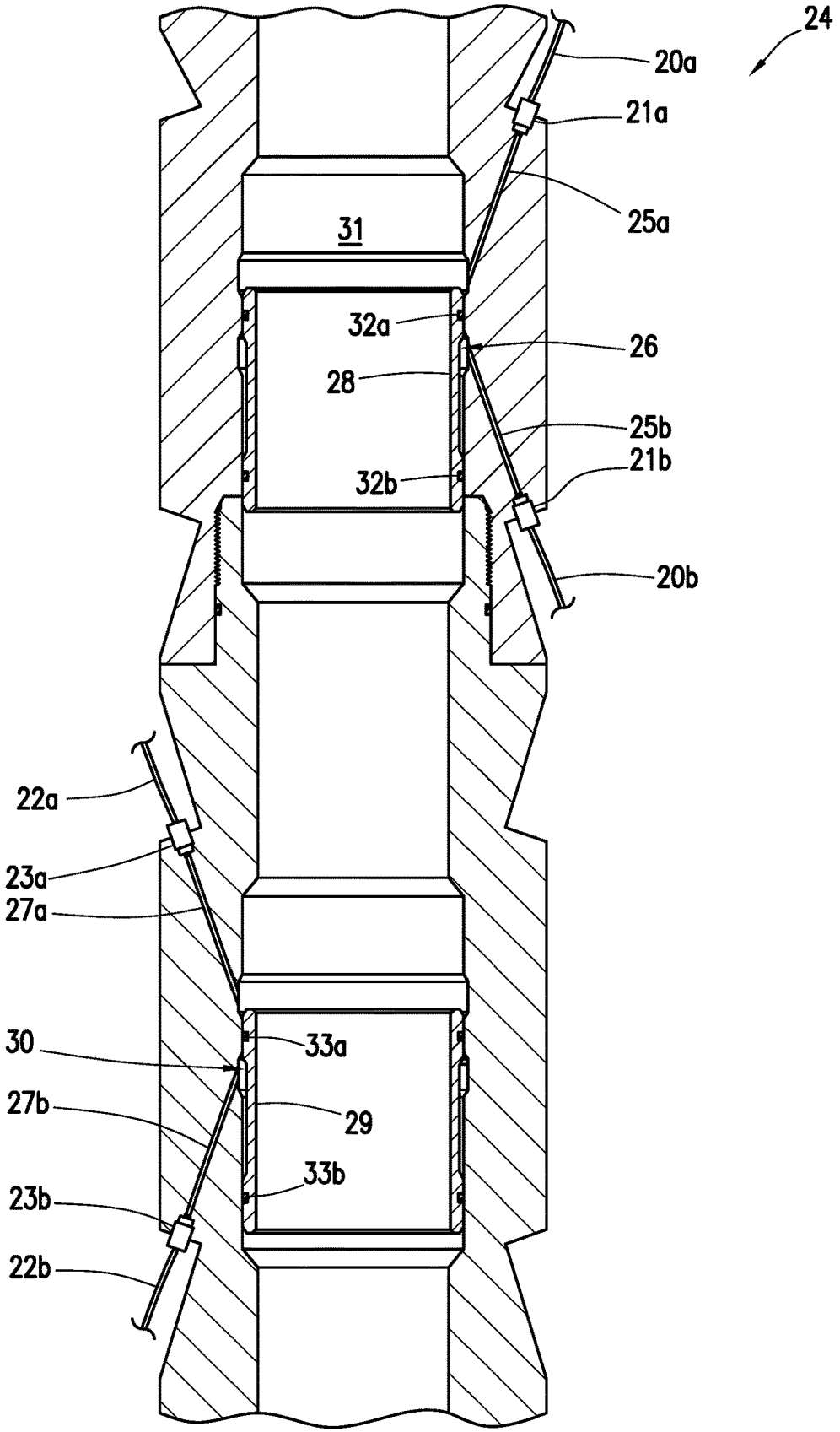
Figure 3C:
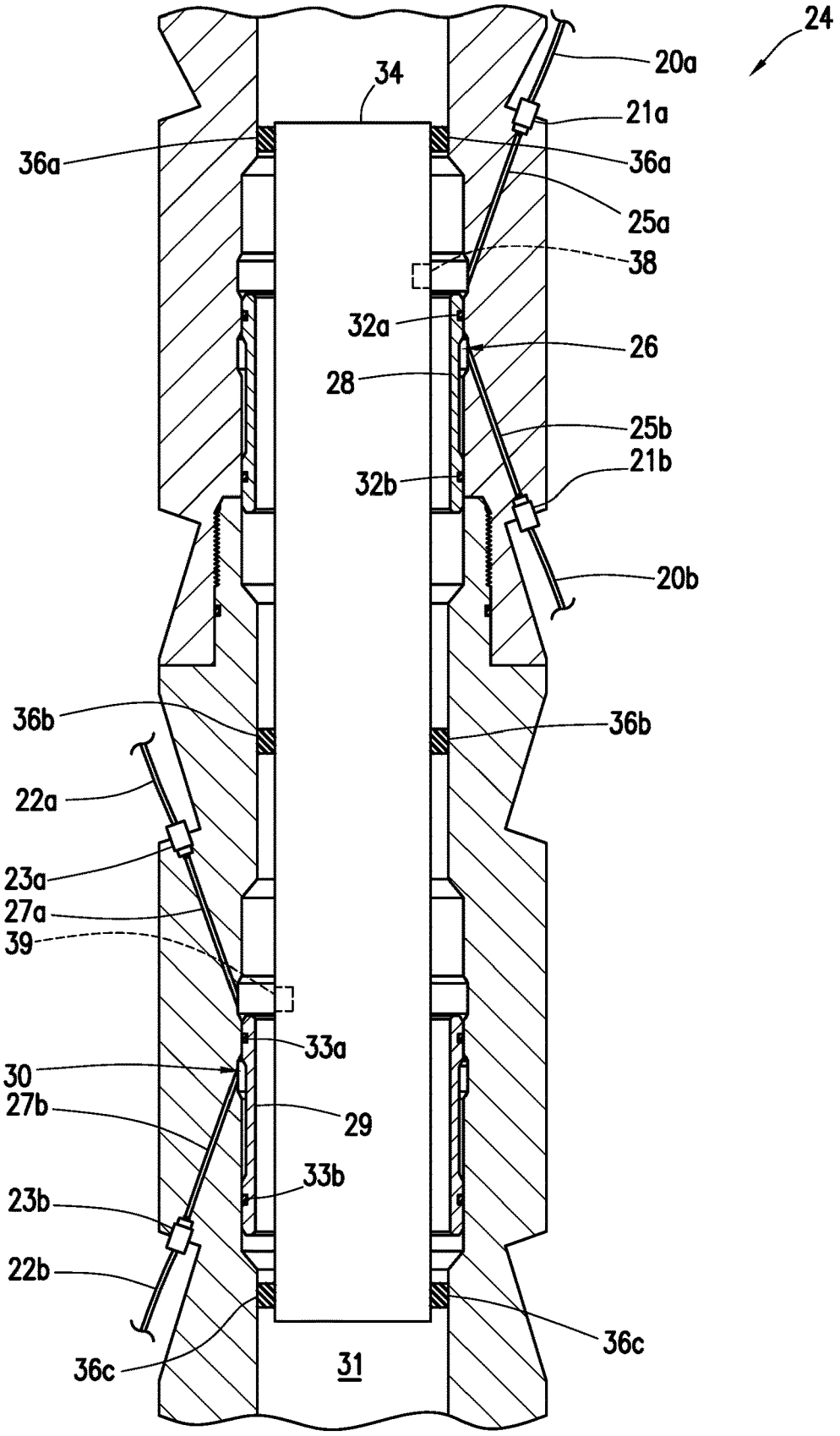

FIGS. 3A-3C show schematics of an illustrative nipple configuration in which dual sliding sleeves may affect switching of control line 20 and balance line 22. In the interest of clarity, the disposition of nipple 24 and safety valve 16 within tubing string 14 is not depicted in FIGS. 3A-3C. In most instances, elements having a common structure and function to those of previously described FIGURES will be assigned a common reference character in the drawings and will not be discussed again in detail. A configuration similar to that depicted in FIG. 1 may be used in some embodiments, although other configurations are certainly possible. FIG. 3A shows the normal operational state of wellbore system 1, in which both control line 20 and balance line 22 maintain hydraulic communication with safety valve 16. Specifically, upper portion 20*a* of control line 20 is connected to control line port 21*a*, and lower portion 20*b* of control line 20 is connected to control line port 21*b*. Lower portion 20*b* of control line 20 leads to safety valve 16 and establishes hydraulic communication therewith. Hydraulic communication between upper portion 20*a* and lower portion 20*b* takes place through control line conduits 25*a* and 25*b*, each defined within the sidewall of nipple 24. Hydraulic communication between control line conduits 25*a* and 25*b* is maintained through recess 26, which is defined between sliding sleeve 28 and the internal profile of nipple 24. Similarly, upper portion 22*a* of balance line 22 is connected to balance line port 23*a*, and lower portion 22*b* of balance line 22 is connected to balance line port 23*b*. Balance line conduits 27*a* and 27*b* and recess 30 extend in between upper portion 22*a* and lower portion 22*b* of balance line 22. Recess 30 is defined between sliding sleeve 29 and the internal profile of nipple 24. In the normal operational configuration of FIG. 3A, hydraulic pressurization does not extend into internal flow pathway 31 of nipple 24, other than within recesses 26 and 30. Seals 32*a*, 32*b*, 33*a* and 33*b* maintain hydraulic fluid within recesses 26 and 30 such that the fluid does not enter the remaining portions of internal flow pathway 31. Sliding sleeves 28 and 29 may be maintained in position by various retention mechanisms, such as shear pins and the like (not depicted in FIGS. 3A-3B), until the transfer of hydraulic control is desired.

FIG. 3B shows the nipple configuration of FIG. 3A after axial displacement of sliding sleeves 28 and 29 affects transfer of hydraulic regulation. In particular, by repositioning sliding sleeve 28, recess 26 no longer maintains hydraulic communication between control line conduits 25*a* and 25*b*. Instead, hydraulic fluid is free to enter internal flow pathway 31 of nipple 24 from control line conduit 25*a*, thereby effectively shutting off lower portion 20*b* of control line 20. Similarly, by repositioning sliding sleeve 29, recess 30 no longer maintains hydraulic communication between balance line conduits 27*a* and 27*b*, and hydraulic fluid from balance line conduit 27*a* is free to enter internal flow pathway 31 of nipple 24. By positioning an insert safety valve (not depicted in FIGS. 3A and 3B) within internal flow pathway 31, upper portion 20*a* of control line 20 and upper portion 22*b* of balance line 22 may be used to hydraulically control an insert safety valve within nipple 24, as described hereinafter.

FIG. 3C shows the nipple configuration of FIG. 3B with insert safety valve 34 in place after axial displacement of sliding sleeves 28 and 29. As shown in FIG. 3C, insert safety valve 34 is positioned within internal flow pathway 31 of nipple 24 such that insert safety valve 34 may receive hydraulic fluid from control line conduit 25*a* and balance line conduit 27*a* in order to undergo hydraulic pressurization. Seals 36*a*-36*c* around insert safety valve 34 contain the hydraulic fluid from each source within a defined space and keep the two sources of hydraulic fluid from mixing with one another. Specifically, seals 36*a* and 36*b* direct hydraulic fluid from control line conduit 25*a* to control line port 38 on insert safety valve 34, and seals 36*b* and 36*c* direct hydraulic fluid from balance line conduit 27*a* to balance line port 39 on insert safety valve 34. Seal 36*b* thereby prevents the two sources of hydraulic fluid from mixing with one another, thereby allowing control line 20 and balance line 22 to be independently regulated in operating insert safety valve 34. Insert safety valve 34 may be a flapper-type valve, such as one similar to that depicted in FIG. 2, and it may be operated by appropriately pressurizing and depressurizing control line 20 and balance line 22 to open and close the flapper valve (details not shown). Further, insert safety valve 34 may be of a similar design to safety valve 16 that it has replaced, or it may be of an entirely different design. For example, the mechanism for actuating the flapper valve may differ between safety valve 16 and insert safety valve 34.

Sliding sleeves 28 and 29 may be configured for axial displacement by any suitable technique. In some embodiments, a wireline tool, such as a jarring mechanism, may be used to affect the axial displacement of sliding sleeves 28 and 29. Suitable wireline tools for this purpose will be familiar to one having ordinary skill in the art. In other embodiments, the placement of insert safety valve 34 within internal flow pathway 31 may axially displace sliding sleeves 28 and 29. Suitable features of sliding sleeves 28 and 29 that allow their axial displacement by a wireline tool or insert safety valve positioning will be familiar to one having ordinary skill in the art.

Suitable techniques for positioning insert safety valve 34 within nipple 24, such as through wireline, braided line, or coiled tubing deployment, will be familiar to one having ordinary skill in the art. Threading, landing shoulders and like structures intended to facilitate positioning of insert safety valve 34 may be present as part of the internal profile of nipple 24. In the interest of clarity, these features are not depicted in any particular detail in FIGS. 3A-3C. Before or after placing insert safety valve 34, safety valve 16 may be mechanically locked in an open position such that it is permanently bypassed within tubing string 16, thereby turning its fluid control function over to insert safety valve 34.

Once hydraulic communication has been transferred to nipple 24, insert safety valve 34 may be operated in a substantially similar manner to that of safety valve 16 by pressurizing and depressurizing control line 20 and balance line 22 in a desired manner. Further, in alternative embodiments, a single-line insert safety valve may be used as an alternative to a dual-line insert safety valve, such as that depicted in FIG. 3C. Single-line insert safety valves may be utilized upon redirecting hydraulic flow from at least one of control line 20 or balance line 22 to internal flow pathway 31, as discussed in brief above.

In alternative embodiments, a sliding sleeve may be coupled to various structures configured to transfer hydraulic regulation from a primary safety valve to an insert safety valve. Axial displacement of the sliding sleeve may indirectly affect hydraulic switching in such configurations. Specifically, a sliding sleeve may be mechanically coupled to a piston assembly in order to affect its axial displacement for switching between a primary safety valve and an insert safety valve.

Figure 4A:
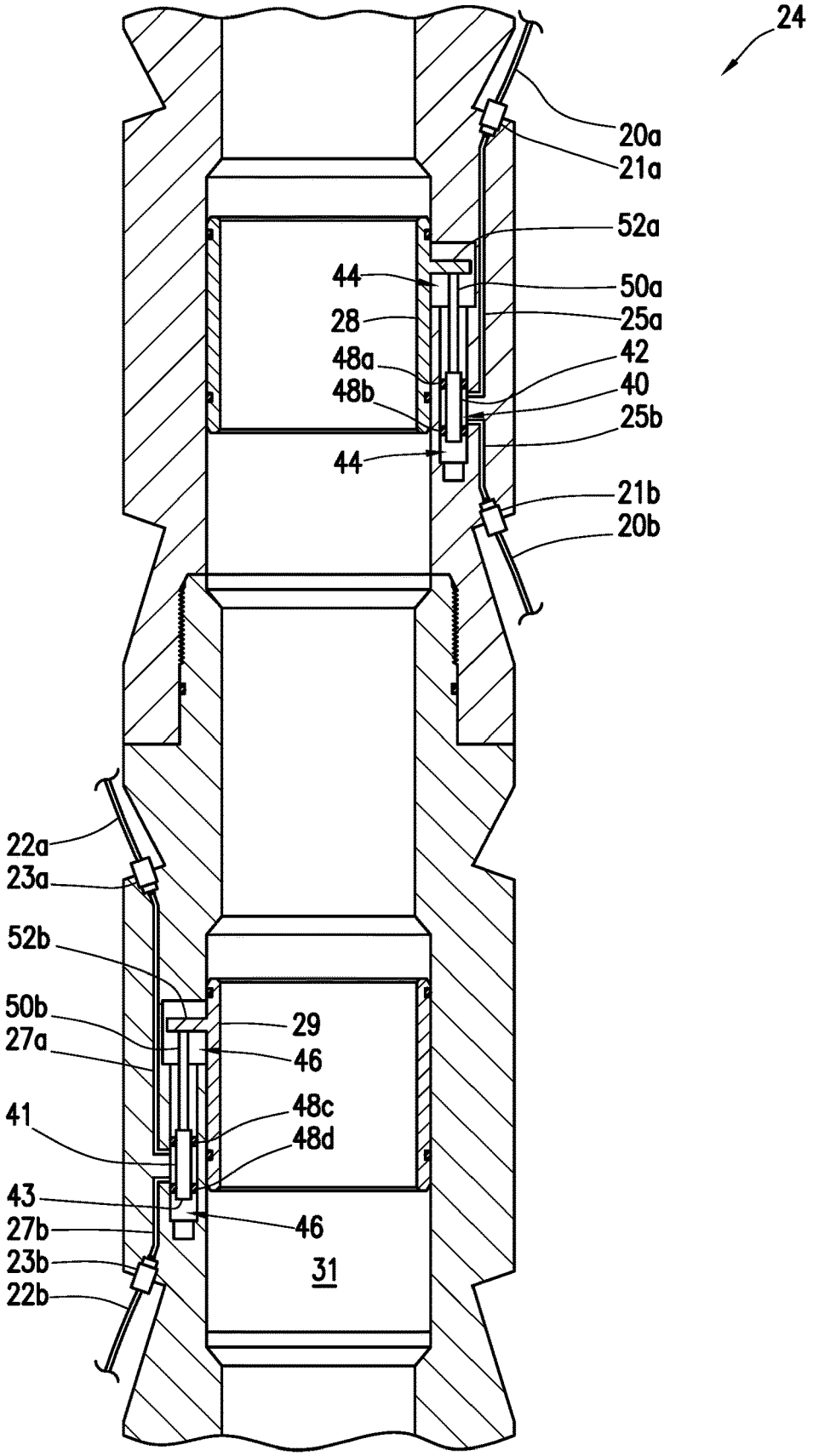
FIGS. 4A and 4B show schematics of an illustrative nipple configuration in which dual sliding sleeves may affect switching of a control line and a balance line through axial motion of a piston assembly.
Figure 4B:
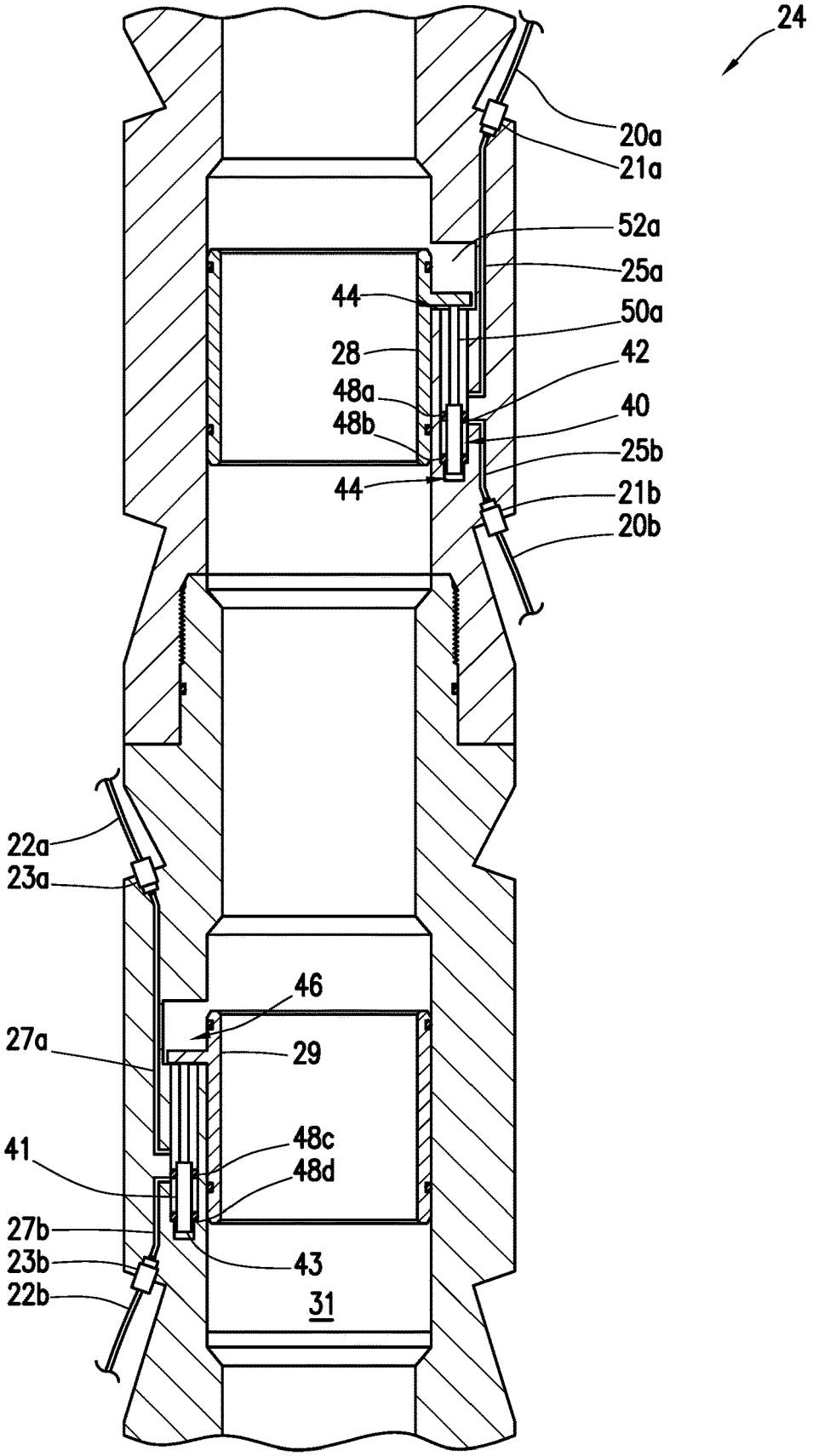

FIGS. 4A and 4B show schematics of an illustrative nipple configuration in which dual sliding sleeves may affect switching of a control line and a balance line through axial motion of a piston assembly. Whereas sealing is maintained around sliding sleeves 28 and 29 in the nipple configurations of FIGS. 3A-3C in order to allow hydraulic pressurization of a primary safety valve to take place, sealing in the nipple configurations of FIGS. 4A and 4B is instead provided around a piston assembly, as discussed in further detail below.

Referring now to FIG. 4A, control line conduits 25*a* and 25*b* are defined within nipple 24 and establish hydraulic communication with safety valve 16 (not shown in FIGS. 4A and 4B) via recess 40 that is defined about piston assembly 42. Specifically, hydraulic fluid flows through control line conduit 25*a* to control line conduit 25*b* via recess 40 in order for hydraulic regulation of safety valve 16 to take place using control line 20. Similarly, hydraulic fluid flows through balance line conduit 27*a* to balance line conduit 27*b* via recess 41 defined about piston assembly 43 in order for hydraulic regulation of safety valve 16 to take place using balance line 22. Piston assemblies 42 and 43 are housed within cavities 44 and 46, respectively, each of which is open to internal flow pathway 31 within nipple 24. In FIG. 4A, hydraulic fluid does not enter either of cavities 44 or 46 and remains within recesses 40 and 41 in the course of passing to safety valve 16. Seals 48*a* and 48*b* around piston assembly 40 maintain hydraulic fluid within recess 40, and seals 48*c* and 48*d* around piston assembly 41 likewise maintain hydraulic fluid within recess 41.

With continued reference to FIG. 4A, rods 50*a* and 50*b* are operably connected to piston assemblies 42 and 43, respectively. Arms 52*a* and 52*b*, in turn, operably connect sliding sleeves 28 and 29, respectively, to rods 50*a* and 50*b*. Hence, axial displacement of sliding sleeves 28 and 29 can affect a corresponding displacement of piston assemblies 42 and 43 within cavities 44 and 46, respectively. Although not depicted in FIGS. 4A and 4B, the movement of piston assemblies 42 and 43 may be optionally resisted by a spring or similar biasing device.

FIG. 4B shows the nipple configuration of FIG. 4A after axial displacement of sliding sleeves 28 and 29. Upon moving sliding sleeves 28 and 29 downwardly, a corresponding change in the position of piston assemblies 42 and 43 occurs within cavities 44 and 46, respectively. Upon moving piston assemblies 42 and 43, recesses 40 and 41 are no longer positioned to maintain hydraulic communication to lower portion 20*b* of control line 20 and lower portion 22*b* balance line 22. Instead, upon switching, hydraulic fluid from control line conduit 25*a* can enter cavity 44 and progress to internal flow pathway 31 of nipple 24, and hydraulic fluid from balance line conduit 27*a* can similarly enter cavity 46 and access internal flow pathway 31. Upon placing an insert safety valve (not shown in FIGS. 4A and 4B) in internal flow pathway 31, hydraulic operation of this valve may be realized. Placement of the insert safety valve and sealing about the insert safety valve may take place in a similar manner to that depicted in FIG. 3C and will not be depicted again in the interest of brevity. Again, through providing appropriately placed sealing around the insert safety valve, the hydraulic fluid from control line conduit 25*a* and balance line conduit 27*a* may be kept separate from one another, thereby allowing control line 20 and balance line 22 to independently operate the insert safety valve.

In the nipple configurations described above, the mechanical switching mechanism for transferring hydraulic regulation from safety valve 16 to an insert safety valve resides within nipple 24 itself. That is, the switching effect is integral with nipple 24. Specifically, in the previously described embodiments, switching of the hydraulic regulation may take place by virtue axial displacement of sliding sleeves 28 and 29, each of which is disposed within nipple 24. In alternative embodiments, switching of the hydraulic regulation from safety valve 16 to the insert safety valve may take place in a sub that is spaced apart from nipple 24. Further disclosure in this regard follows below. As used herein, the term "sub" will refer to a short section of a tubular string that is separate from nipple 24. In some embodiments, switching of the hydraulic regulation may be affected by one or more sliding sleeves housed within the sub. Other mechanisms for switching hydraulic regulation within a sub are also discussed hereinbelow and may be implemented based upon various design considerations. For example, one may choose to provide the mechanical mechanism for switching hydraulic regulation within a sub instead of within nipple 24 in order to simplify the ease of manufacturing of nipple 24. Further, just as the various mechanisms for providing mechanical switching of hydraulic regulation may be separately provided in a sub, the various configurations for a sub that are depicted and described hereinafter may be alternatively implemented as an integral portion of nipple 24. However, using a sub that is separate from nipple 24 may allow the sub to be located at a relatively shallow depth to facilitate switching using wireline tools, while nipple 24 can be located at an arbitrary depth as dictated by downhole conditions or customer preferences.

Figure 5:
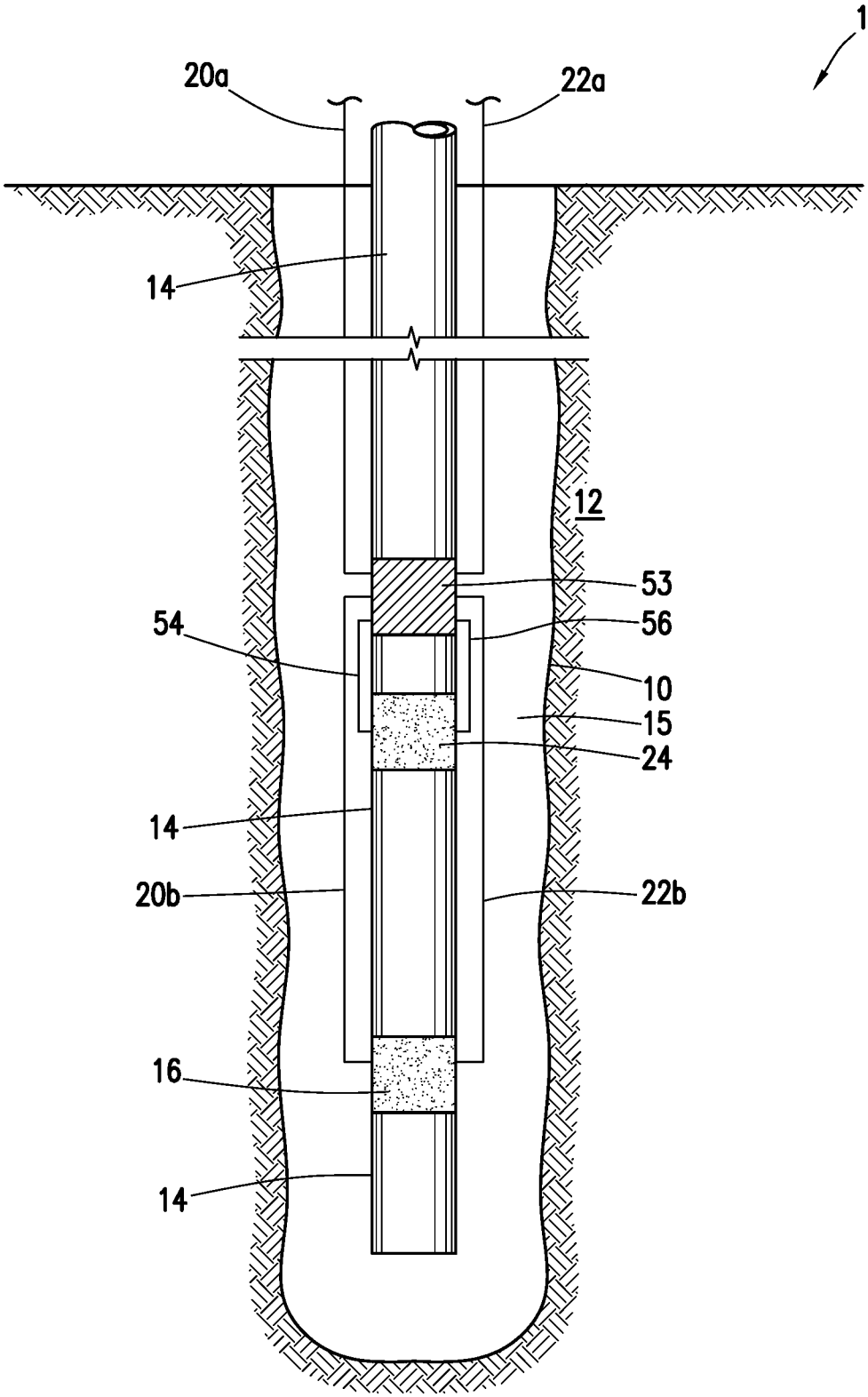
FIG. 5 shows an illustrative schematic of a wellbore system containing a tubing string having a sub, a nipple and a tubing-retrievable safety valve attached thereto.

FIG. 5 shows an illustrative schematic of a wellbore system containing a tubing string having a sub, a nipple and a tubing-retrievable safety valve attached thereto. FIG. 5 bears various similarities to FIG. 1 and may be better understood by reference thereto. Only differences resulting from the incorporation of sub 53 within tubing string 14 will be discussed further herein. Whereas control line 20 and balance line 22 were contiguous in FIG. 1 and proceeded directly from the earth's surface to tubing retrievable safety valve 16, sub 53 intervenes in these lines in FIG. 5. Specifically, upper portion 20*a* of control line 20 and upper portion 22*b* of balance line 22 extend to sub 53 in FIG. 5. Lower portion 20*b* of control line 20 and lower portion 22*b* of balance line 22 likewise extend from sub 53 to safety valve 16. Also extending from sub 53 to nipple 24 are latent control line 54 and latent balance line 56. Under normal operational conditions in which safety valve 16 is still being regulated, latent control line 54 and latent balance line 56 are simply inactive and nipple 24 is bypassed. Once deployment and actuation of an insert safety valve within nipple 24 is desired, a mechanical switching mechanism within sub 53 can be actuated to shut off lower portion 20*b* of control line 20 and lower portion 22*b* of balance line 22. In doing so, latent control line 54 and latent balance line 56 become active and allow diversion of hydraulic fluid to nipple 24 to take place, thereby allowing the insert safety valve to be hydraulically regulated. That is, sub 53 can establish hydraulic communication between upper portion 20*a* of control line 20 and latent control line 54 and between upper portion 22*b* of balance line 22 and latent balance line 56, thereby allowing hydraulic regulation of an insert safety valve to take place. Various mechanisms within sub 53 for transferring hydraulic regulation to nipple 24 via latent control line 54 and latent balance line 56 are discussed hereinafter. Although FIG. 5 has depicted lower portion 20*a* of control line 20 and lower portion 22*b* of balance line 22 as completely bypassing nipple 24, it is to be recognized that these lines may also pass through the sidewall of nipple 24, if desired, without departing from the scope of the present disclosure. When these lines pass through nipple 24 in such a manner, they are not disposed such that they establish hydraulic communication with internal flow pathway 31.

Figure 6A:
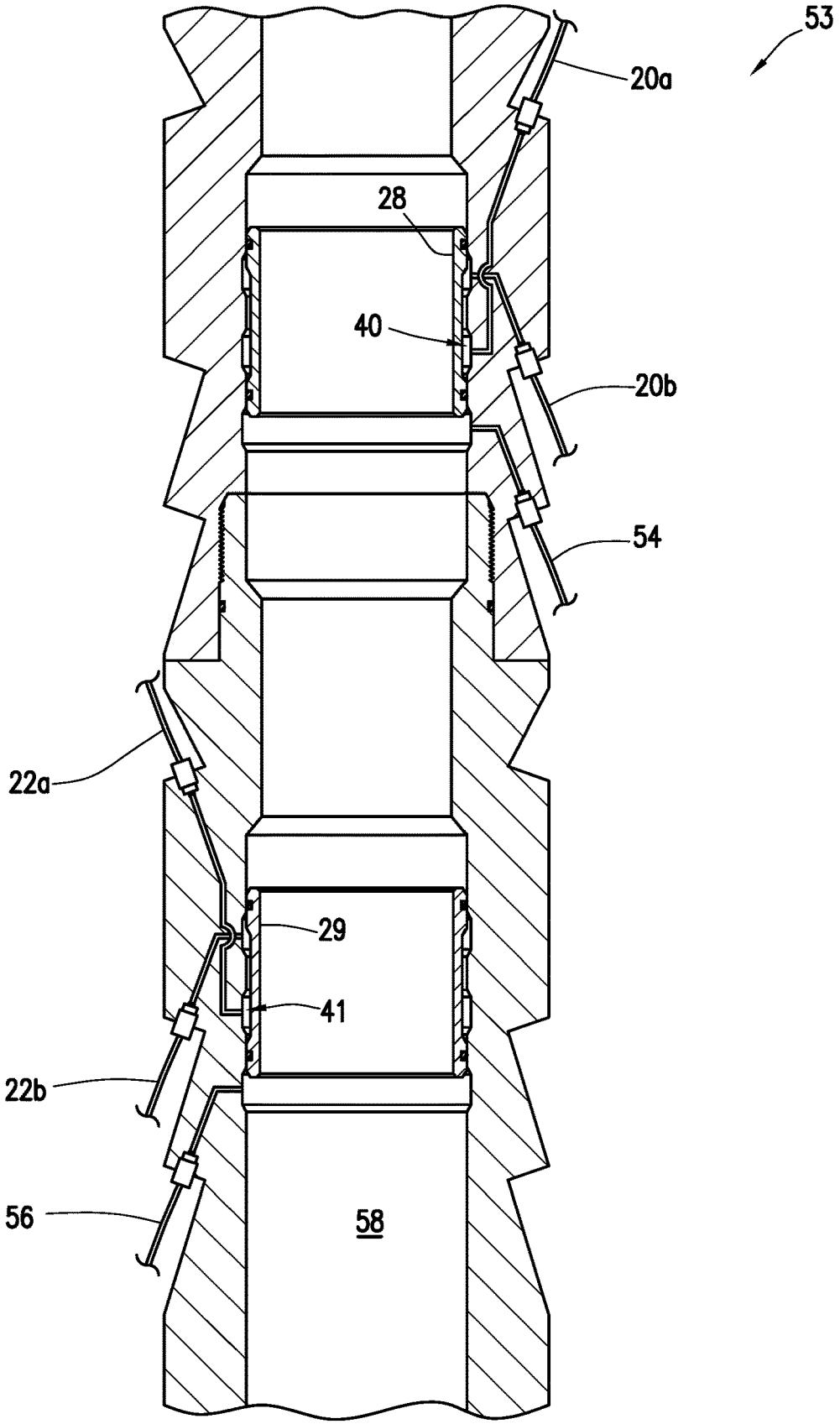
FIGS. 6A and 6B show schematics of an illustrative sub in which hydraulic regulation may be switched by way of one or more sliding sleeves.
Figure 6B:
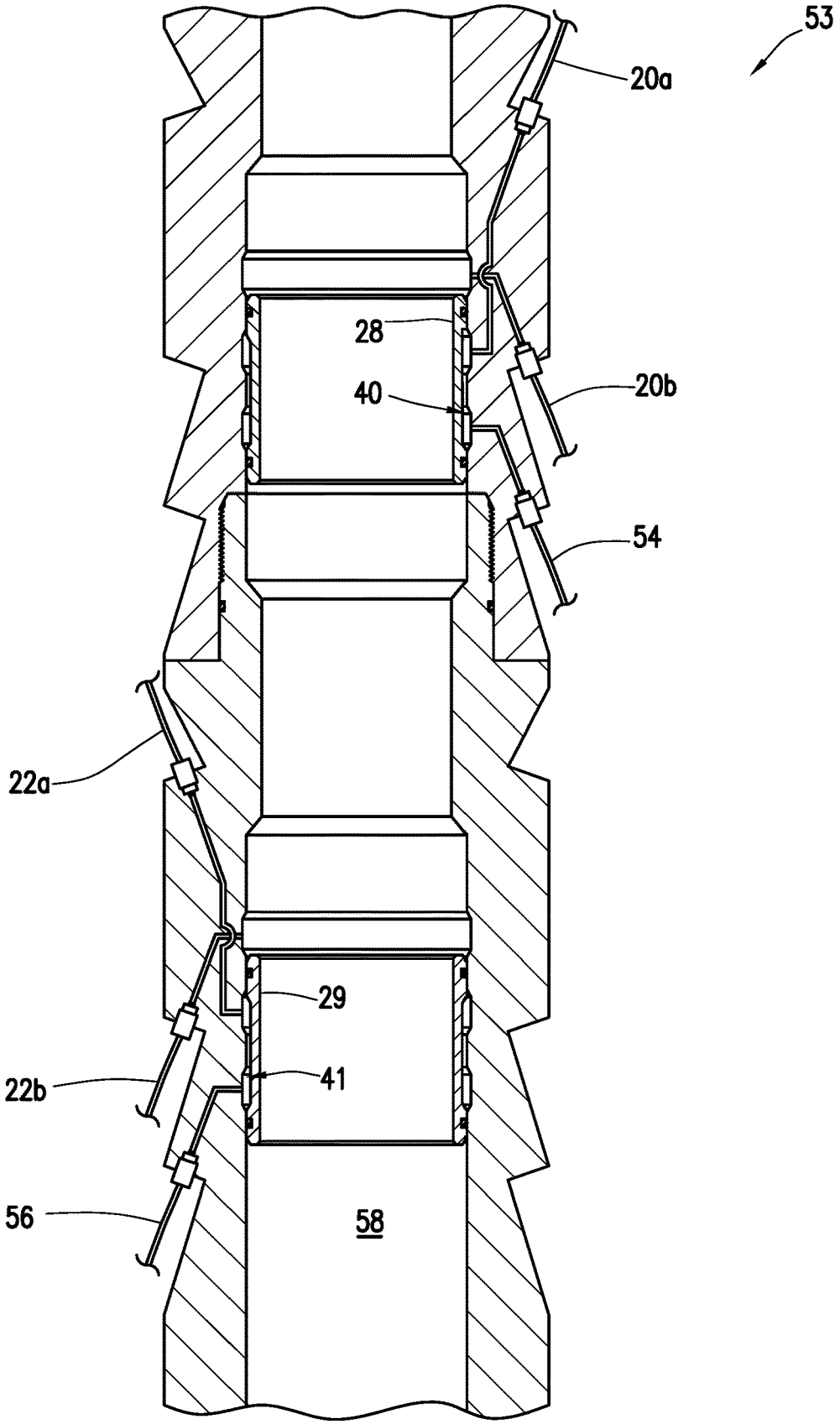

In some embodiments, sliding sleeve configurations similar to those depicted in FIGS. 3A-3C and 4A-4B may be implemented in sub 53. By way of illustration, FIGS. 6A and 6B show schematics of an illustrative sub in which hydraulic regulation may be switched by way of one or more sliding sleeves housed within the sub. The mechanical switching mechanism afforded by sliding sleeves 28 and 29 in FIG. 6A and FIG. 6B bears similarities to that of FIGS. 3A-3C and accordingly will only be discussed further in brief herein.

Referring in more detail to FIGS. 6A and 6B, sub 53 contains sliding sleeves 28 and 29 within internal flow pathway 58. Recesses 40 and 41 are defined between sliding sleeves 28 and 29 and the body of sub 53, thereby allowing hydraulic fluid to flow between upper portion 20*a* and lower portion 20*b* of control line 20 and between upper portion 22*a* and lower portion 22*b* of balance line 22. In the configuration of FIG. 6A, latent control line 54 is not in hydraulic communication with recess 40 and is inactive. Latent balance line 56 is similarly not in hydraulic communication with recess 41 and is similarly inactive. Upon axially displacing sliding sleeves 28 and 29, however, as shown in FIG. 6B, hydraulic communication is established between upper portion 20*a* of control line 20 and latent control line 54, and similarly between upper portion 22*a* of balance line 22 and latent balance line 56. In FIG. 6B, hydraulic fluid no longer flows through lower portion 20*b* of control line 20 and lower portion 22*b* of balance line 22, thereby shutting off these lines and effectively deactivating safety valve 16.

Figure 7A:
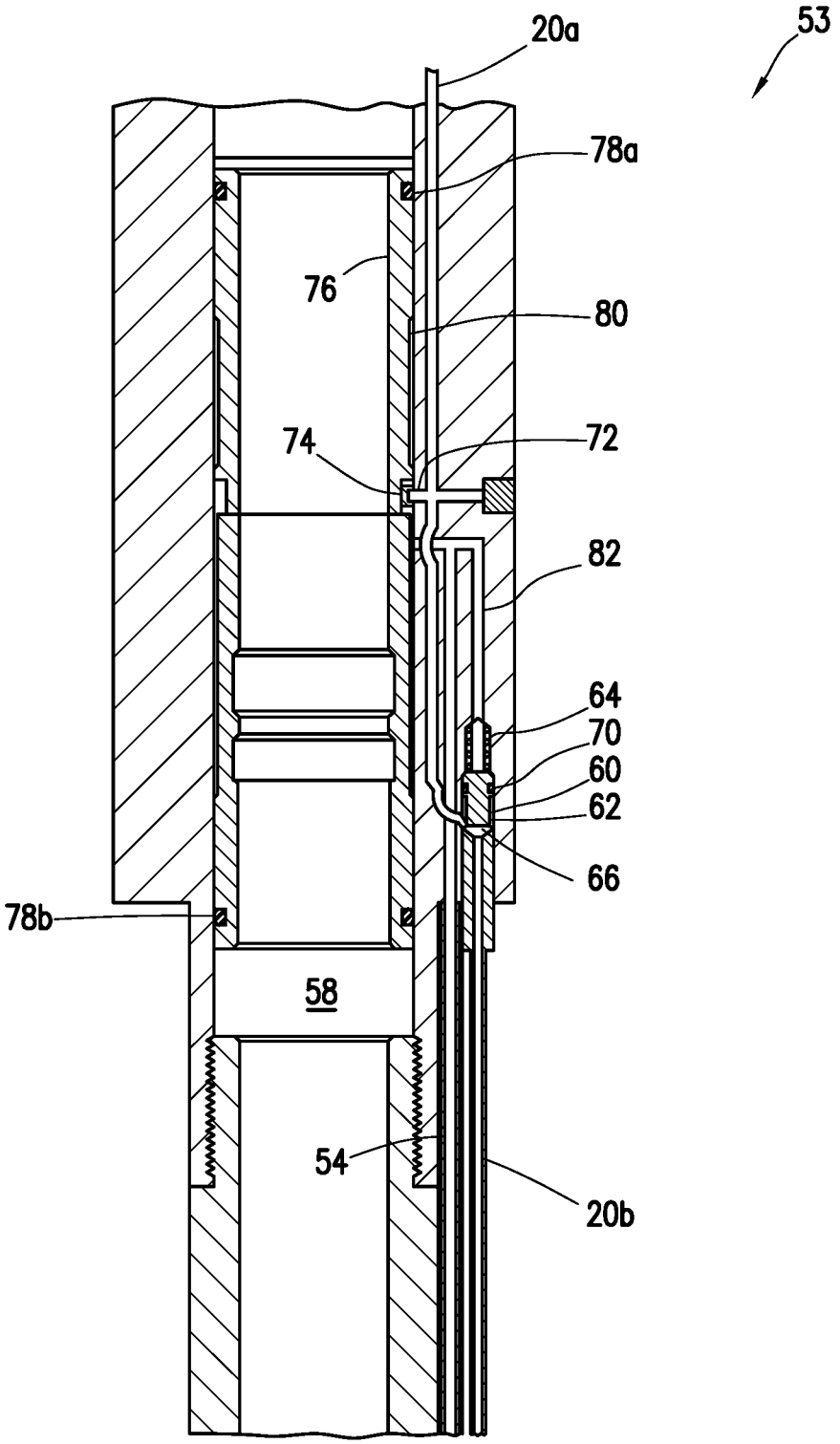
FIGS. 7A and 7B show schematics of another illustrative sub in which hydraulic regulation may be switched by way of one or more sliding sleeves housed within the sub.
Figure 7B:
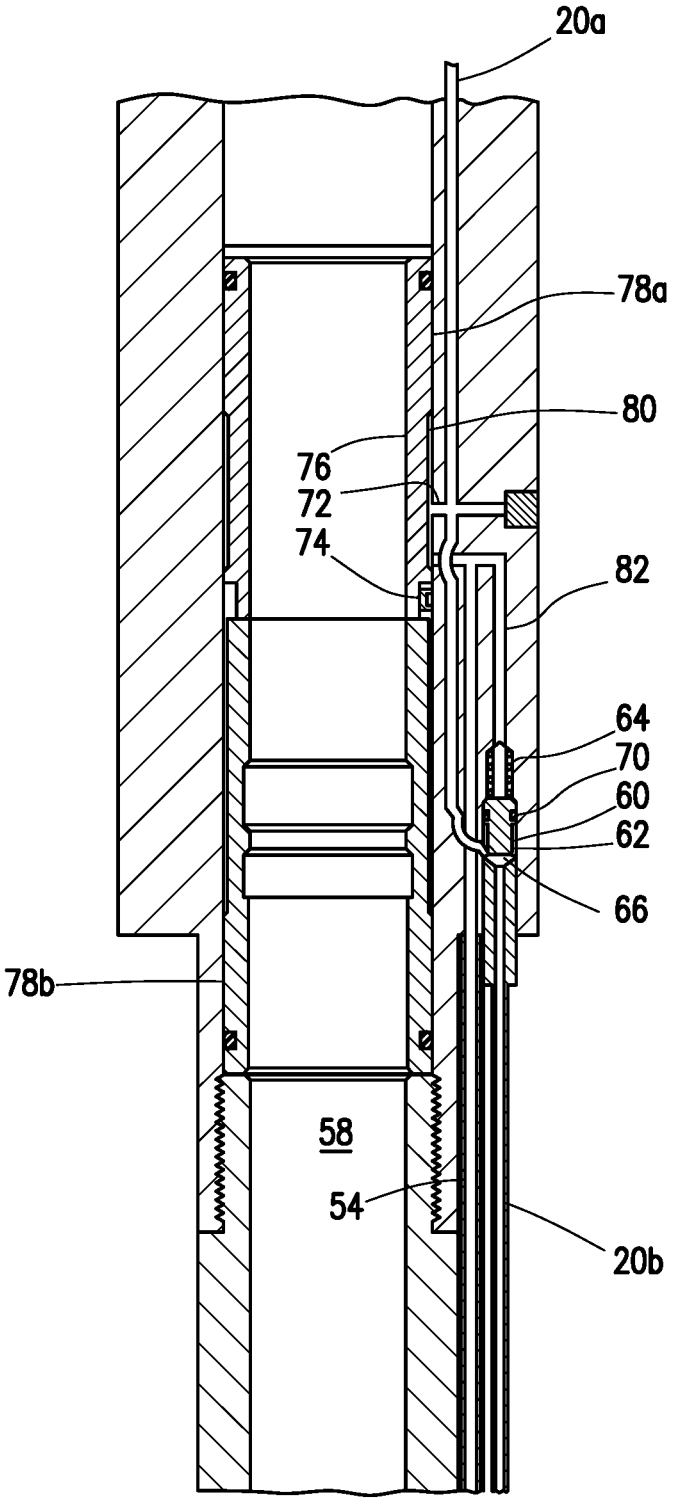

FIGS. 7A and 7B show schematics of another illustrative sub in which hydraulic regulation may be switched by way of one or more sliding sleeves housed within the sub. In the interest of conciseness and brevity, FIGS. 7A and 7B only show a sliding sleeve and related components for transferring hydraulic regulation from lower portion 20*b* of control line 20 to latent control line 54. However, it is to be recognized that a similar switching mechanism may be provided to transfer hydraulic regulation of lower portion 22*b* of balance line 22 to latent balance line 56. Separate sliding sleeves may be used for this purpose, or a single sliding sleeve may be used to switch both lines simultaneously. When a single sliding sleeve is used, separated, the sliding sleeve may be appropriately sealed to maintain separation between the hydraulic fluid originating from control line 20 and balance line 22.

FIG. 7A shows as illustrative side view schematic of sub 53 in which sliding sleeve 76 may cause transfer of hydraulic regulation from control line 20 to latent control line 54. As shown in FIG. 7A, upper portion 20*a* control line 20 enters the top of sub 53, and lower portion 20*b* of control line 20 exits through the bottom. Within the sidewall of sub 53, upper portion 20*a* of control line 20 is in hydraulic communication with piston chamber 60. Piston chamber 60 contains piston assembly 62 and spring 64. The spring force of spring 64 pushes piston assembly 62 toward piston seat 66. Piston seat 66 is located at the upper terminus of lower portion 20*b* of control line 20. If mating occurs between piston assembly 62 and piston seat 66, hydraulic flow to lower portion 20*b* of control line 20 terminates. Under normal operational conditions, hydraulic pressure from hydraulic fluid within upper portion 20*a* of control line 20 tends to resist the spring force and displace piston assembly 62 away from piston seat 66, thereby keeping the entirety of control line 20 open. Seal 70 within piston chamber 70 allows sufficient hydraulic pressure to build to resist the spring force.

As long as there is sufficient hydraulic pressure present in upper portion 20*a* of control line 20 to resist the spring force, lower portion 20*b* of control line 20 may remain open. If lower portion 20*b* of control line 20 is breached or otherwise becomes inoperable, it may no longer be possible to build sufficient hydraulic pressure to resist the spring force and keep piston assembly 62 from mating with piston seat 66. Thus, if sufficient hydraulic pressure is not maintained, piston assembly 62 may automatically close and seal off lower portion 20*b* of control line 20. As described further hereinbelow, sub 53 may contain further mechanisms that promote mating of piston assembly 62 and piston seat 66 to accomplish this purpose.

Referring still to FIG. 7A, branch 72 intersects upper portion 20*a* of control line 20 within the body of sub 53 and extends to its interior. Shearable lug 74 blocks branch 72 from releasing hydraulic fluid into the interior of sub 53 and holds sliding sleeve 76 in place. Shearable lug 74 may be held in place with sliding sleeve 76 and optionally may be further secured in place by a compression fit and/or a retaining ring (snap ring). Recess 80 is defined within sliding sleeve 76, and seals 78*a* and 78*b* are maintained on either side of recess 80.

In order to switch hydraulic regulation from lower portion 20*b* of control line 20 to latent control line 54, sliding sleeve 76 is axially displaced into a second position, as shown in FIG. 7B. Shearable lug 74 breaks in the axial displacement process and opens branch 72 to the interior of sub 53. Sliding sleeve 76 may be hardened to promote the shearing process. Hence, until shearable lug 74 is broken, safety valve 16 remains operative and all sealing is advantageously metal-to-metal. Upon being axially displaced, recess 80 receives the exiting hydraulic fluid from branch 72 and transfer it to latent control line 54. Latent control line 54 also extends to the interior of sub 53.

Referring still to FIG. 7B, branch 82 extends between latent control line 54 and piston chamber 60. Hydraulic fluid exiting branch 82 tends to displace piston assembly 62 toward piston seat 66. That is, the hydraulic fluid within branch 82 at the upend of piston chamber 60 aids spring 64 in affecting closure of lower portion 20*b* of control line 20 by translating piston assembly 62. Even if the hydraulic pressures are the same in upper portion 20*a* of control line 20 at piston seat 66 and in branch 82 at the upend of piston chamber 60, the directions of the hydraulic forces are in opposition to one another, thereby allowing the spring force to mate piston assembly 62 against piston seat 66. Concurrently, hydraulic fluid can flow through the remainder of latent control line 54 onward toward nipple 24.

Alternately, by employing a modified sliding sleeve 76, shearable lug 74 may be omitted in the configurations of FIGS. 7A and 7B while still achieving a similar result. In particular, branch 72 may be left open by omitting shearable lug 74, and replacing the depicted sliding sleeve 76 with a sliding sleeve having appropriate sealing on either side of the exit of branch 72. Hence, by moving sliding sleeve 76 an appropriate distance (e.g., see FIGS. 6A and 6B), hydraulic fluid may flow from branch 72 to branch 82 to achieve a similar result to that described above. This alternative configuration, however, may lack the metal-to-metal sealing benefits described above.

Alternative configurations of a sub that may affect switching of control line 20 and balance line 22 without utilizing axial displacement of a sliding sleeve are also possible. For example, in illustrative configurations, a sub may include a side pocket in which a replaceable spool or other like replaceable valve system may be disposed. Under normal operational conditions, a first replaceable spool may be housed in the side pocket to operate safety valve 16 by control line 20 and balance line 22. The first replaceable spool may be housed in the side pocket initially, or it may be deployed in the side pocket after the tubing string is set in place. Once operation of an insert safety valve within nipple 24 is desired, the first replaceable spool may be substituted with a second replaceable spool (e.g., through wireline deployment techniques) in order to transfer hydraulic regulation of both lines to the insert safety valve. Alternately, separate replaceable spools may be used for shifting control line 20 and balance line 22, although this may necessitate a greater number of downhole wireline interventions.

Figure 8A:
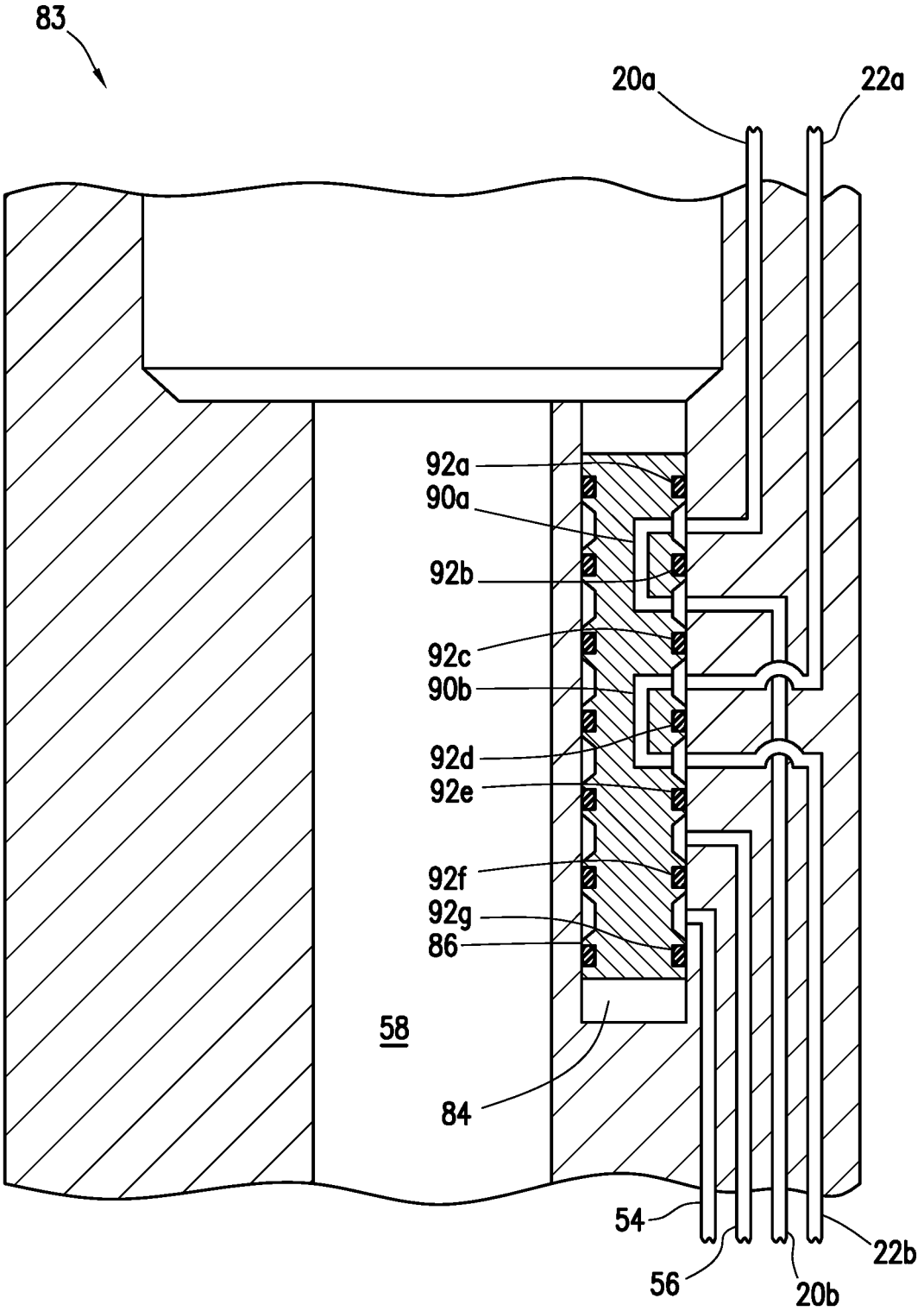
FIGS. 8A and 8B show schematics of another illustrative sub in which hydraulic regulation may be switched by way of a removable spool in a side pocket for directing hydraulic flow.
Figure 8B:
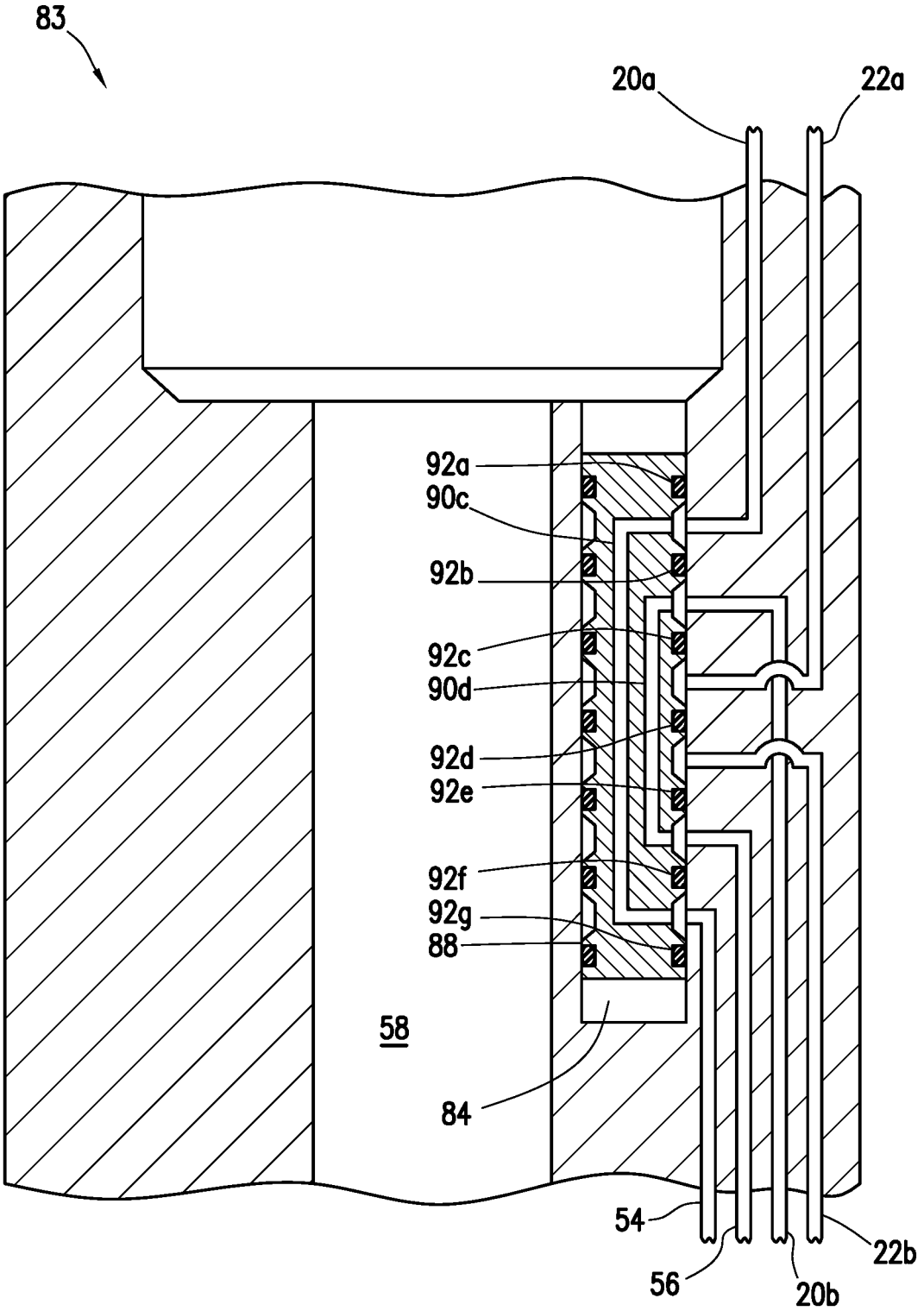

FIGS. 8A and 8B show schematics of another illustrative sub in which hydraulic regulation may be switched by way of a removable spool in a side pocket for directing hydraulic flow. As shown in FIG. 8A, side pocket 84 is defined within the sidewall of sub 83. Side pocket 84 contains a replaceable spool to direct the hydraulic regulation in an appropriate manner. Upper portion 20*a* of control line 20 and upper portion 22*b* of balance line 22 enter the body of sub 83 and make a fluid connection to side pocket 84. In the normal operational configuration of FIG. 8A, first replaceable spool 86 contains internal conduits 90*a* and 90*b* that maintain hydraulic communication between the upper and lower portions of control line 20 and balance line 22, respectively. Latent control line 54 and latent balance line 56 also make fluid connections to side pocket 84. However, when first removable spool 86 is present, there are no appropriately placed internal conduits to connect these lines to upper portion 20*a* of control line 20 and upper portion 22*a* of balance line 22.

Seals 92*a*-*g* are present upon first replaceable spool 86 to allow hydraulic fluid to be conveyed between upper portion 20*a* and lower portion 20*b* of control line 20 and between upper portion 22*a* and lower portion 22*b* of balance line 22. Specifically, seals 92*a*-92*c* allow upper portion 20*a* and lower portion 20*b* of control line 20 to be in hydraulic communication with one another, and seals 92*c*-92*e* allow upper portion 22*a* and lower portion 22*b* of balance line 22 to be in hydraulic communication with one another. These seals also preclude mixing of the hydraulic fluid from the two different sources.

Once it becomes desired to regulate an insert safety valve, first removable spool 86 may be removed from side pocket 84, and second removable spool 88 may be substituted in its place, as shown in FIG. 8B. Wireline techniques may be used to affect removal of first removable spool 86 and replacement with second removable spool 88. Second removable spool 88 contains internal conduits 90*c* and 90*d* that establish hydraulic communication between upper portion 20*a* of control line 20 and latent control line 54 and between upper portion 22*b* of balance line 22 and latent balance line 56. Hydraulic communication with lower portion 20*b* of control line 20 and lower portion 22*b* of balance line 22 are terminated in this process, since appropriately configured internal conduits are no longer present in second removable spool 88. Again, appropriate sealing is provided to connect these lines to one another and preclude mixing of the hydraulic fluids.

In still further embodiments, a third removable spool (not shown in FIGS. 8A and 8B) may be introduced after removing second removable spool 88. In some embodiments, the third removable spool may contain no lines that are positioned to redirect the hydraulic flow. Accordingly, in some embodiments, the third removable spool may serve as a shut off mechanism when wellbore operations are concluded or suspended.

Again, it is to be recognized that the illustrative subs and their various switching mechanisms that are described hereinabove may be made to be contiguous with nipple 24, if desired. Considerations for incorporating the switching mechanisms within nipple 24 may be based upon various operational and/or manufacturing considerations that may be determined by one having ordinary skill in the art. When incorporated within nipple 24, the various switching mechanisms are generally located nearer the upper terminus of tubular string 16 than is the insert safety valve housed within nipple 24.

In still other embodiments, a sliding sleeve within nipple 24 may switch both control line 20 and balance line 22 as an insert safety valve is inserted. In more specific embodiment, axial displacement of a sliding sleeve may move a recess to transfer hydraulic regulation of control line 20 into nipple 24 and actuate a piston to transfer hydraulic regulation of balance line 22 into nipple 24. Further disclosure in this regard follows below.

Figure 9A:
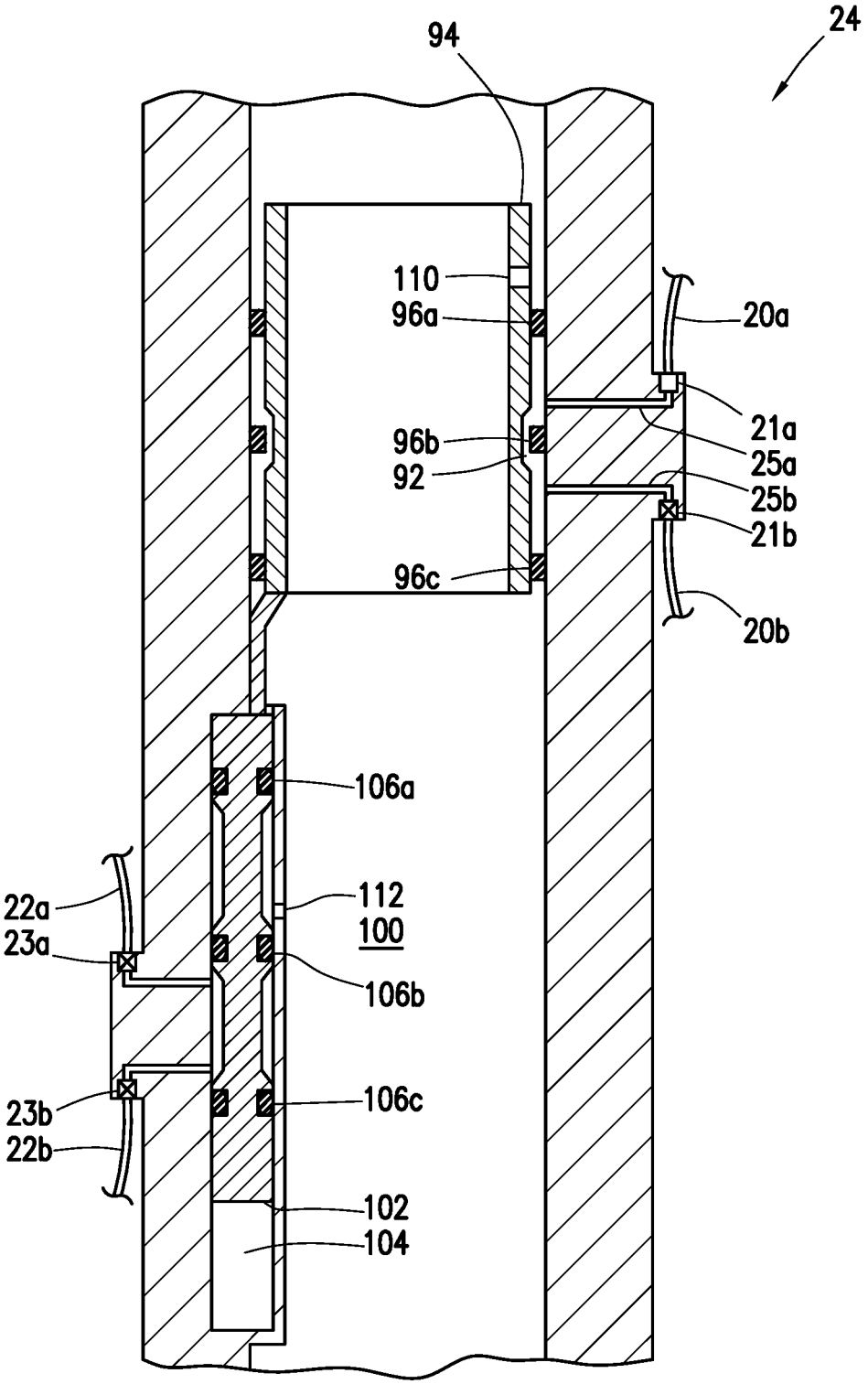
FIGS. 9A and 9B show schematics of an illustrative nipple configuration in which a sliding sleeve may affect switching of both a control line and a balance line.
Figure 9B:
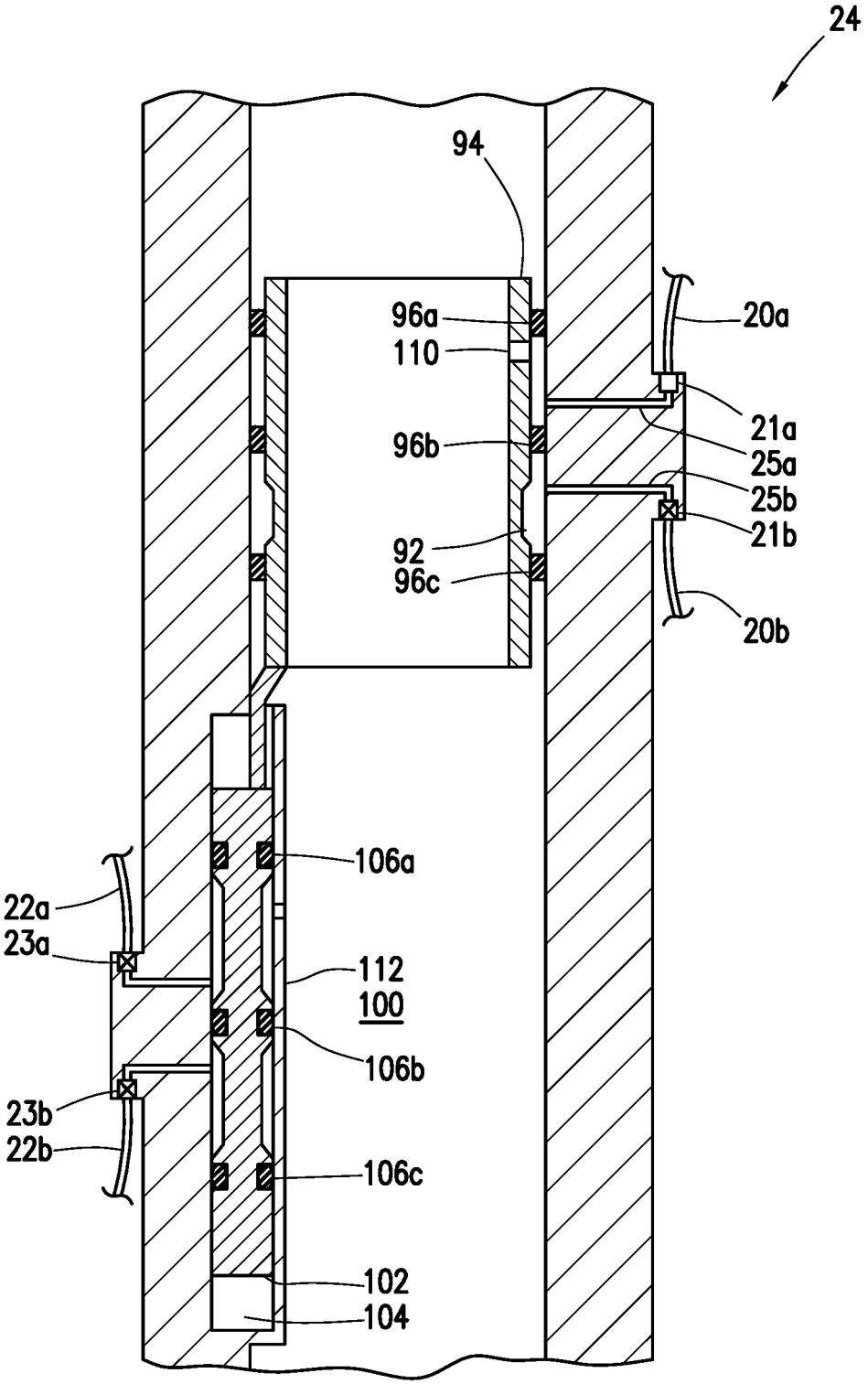

FIGS. 9A and 9B show schematics of an illustrative nipple configuration in which a sliding sleeve may affect switching of both a control line and a balance line. As shown in FIG. 9A, nipple 24 contains control lines ports 21*a* and

21*b*, to which are connected upper portion 20*a* and lower portion 20*b* of control line 20, respectively. Also present are balance line ports 23*a* and 23*b*, to which are connected upper portion 22*a* and lower portion 22*b* of control line 22, respectively. Control line conduits 25*a* and 25*b* are defined within the body of nipple 24 and establish hydraulic communication between upper portion 20*a* and lower portion 20*b* of control line 20. Hydraulic fluid passes from control line conduit 25*a* to control line conduit 25*b* via recess 92 defined between sliding sleeve 94 and nipple 24. Seals 96*a* and 96*c* maintain the hydraulic fluid within recess 96 and preclude it from entering internal flowpath 100.

Piston assembly 102 is located in piston chamber 104. Piston assembly 102 engages with sliding sleeve 94 as it is axially displaced (see FIG. 9B). Seals 106*a*-106*c* are disposed around piston assembly 102 in piston chamber 104. Seals 106*b* and 106*c* allow hydraulic fluid from upper portion 22*a* to lower portion 22*b* of balance line 22 within piston chamber 104.

Latent control line 110 is defined in sliding sleeve 96. In the normal operational configuration of FIG. 9A, hydraulic fluid passes under seal 96*b* and can pressurize lower portion 20*a* of control line 20. Hydraulic fluid from upper portion 20*a* of control line 20 is precluded from entering latent control line 110 by seal 96*a*. Referring now to FIG. 9B, after axially displacing sliding sleeve 96 downwardly, latent control line 110 enters into fluid communication with upper portion 20*a* of control line 20, thereby allowing hydraulic regulation of an insert safety valve to be realized.

Similarly, axially displacement of sliding sleeve 96 results in engagement of piston assembly 102 and its corresponding axial displacement. Latent balance line 112 is defined within nipple 24 and establishes fluid communication between piston chamber 104 and internal flowpath 100. In the normal operational condition of FIG. 9A, hydraulic fluid flows from upper portion 22*a* of balance line 22 to lower portion 22*b* of balance line 22 within piston chamber 104. Hydraulic fluid is precluded from entering latent balance line by seal 106*b*. Referring again to FIG. 9B, after axially displacing sliding sleeve 96 and piston assembly 102 downwardly, hydraulic fluid may flow from upper portion 22*a* of balance line 20 to latent balance line 112 via piston chamber 104, thereby allowing hydraulic regulation of the balance line of an insert safety valve to be realized.

Although FIGS. 9A and 9B have shown a sliding sleeve that affects switching of both a control line and a balance line, it is to be recognized that a similar mechanism may affect switching of single-line safety valves as well. That is, in FIGS. 9A and 9B, the components associated with upper portion 22*a* and lower portion 22*b* of balance line 22 may be omitted, and an insert safety valve having only a control line may be hydraulically regulated with upper portion 20*a* of control line 20 and latent hydraulic line 110 once switching takes place.

Figure 10A:
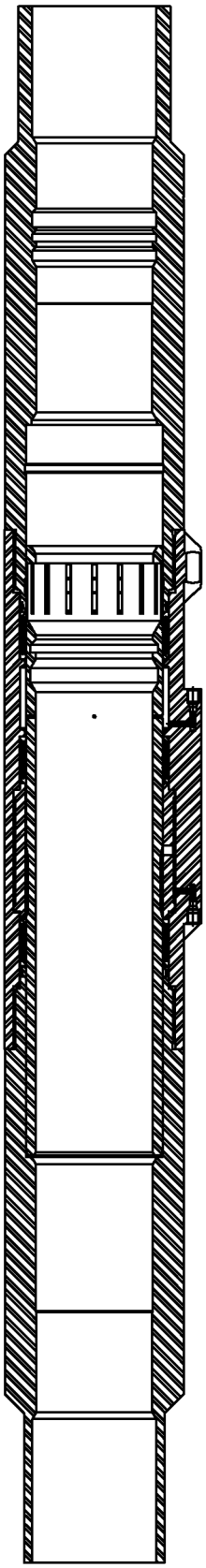
FIGS. 10A, 10B, 11A and 11B show more detailed engineering schematics related to the nipple configuration of FIGS. 9A and 9B.
Figure 10B:
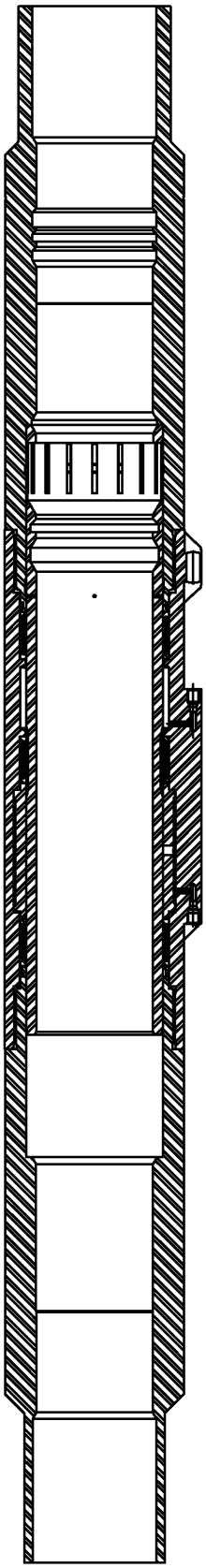
Figure 11A:
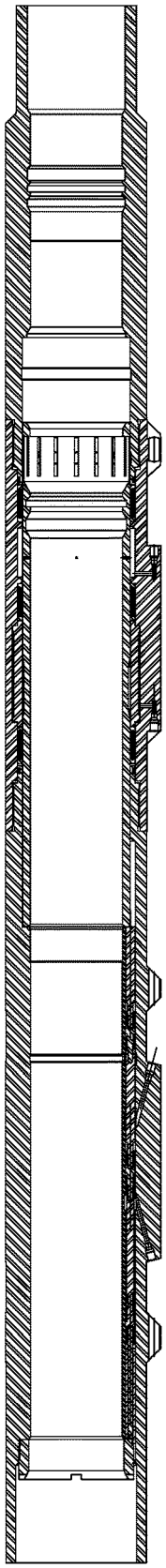
Figure 11B:
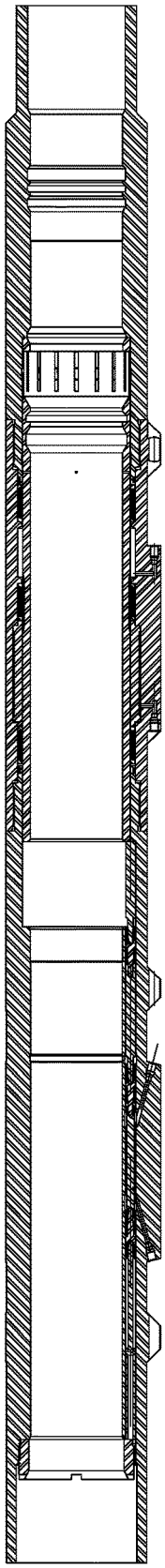

FIGS. 10A, 10B, 11A and 11B show more detailed engineering schematics related to the nipple configuration of FIGS. 9A and 9B. The engineering schematics of FIGS. 10A and 10B show a sliding sleeve that only switches a control line. In contrast, the engineering schematics of FIGS. 11A and 11B show a sliding sleeve that switches both a control line and a balance line.

Embodiments disclosed herein include:

A. Wellbore systems whose hydraulic regulation may be transferred from a primary safety valve to an insert safety valve. The wellbore systems comprise: a tubing string comprising a nipple and a primary safety valve, the primary safety valve being disposed in the tubing string above or below the nipple; a control line and a balance line in hydraulic communication with the primary safety valve and in latent hydraulic communication with an internal flow pathway within the nipple; and a switching mechanism that is axially displaceable to establish hydraulic communication between an insert safety valve positioned in a bore of the nipple and both the control line and the balance line.

B. Wellbore systems whose hydraulic regulation may be transferred from a primary safety valve to an insert safety valve with a replaceable spool. The wellbore systems comprise: a tubing string comprising a nipple and a primary safety valve, the primary safety valve being disposed in the tubing string above or below the nipple; a switching mechanism that is replaceable and is housed in a side pocket defined within an internal flow pathway of the tubing string; and a control line and a balance line in hydraulic communication with the primary safety valve and in latent hydraulic communication with a portion of the internal flow pathway within the nipple; wherein the switching mechanism either establishes hydraulic communication between an upper and a lower portion of the control line and between an upper and a lower portion of the balance line, or between the bore of the nipple and the upper portions of the control line and the balance line.

C. Methods for transferring hydraulic control from a primary safety valve to a secondary safety valve. The methods comprise: placing a tubing string comprising a nipple and a primary safety valve into a wellbore, the primary safety valve being disposed in the tubing string above or below the nipple and the primary safety valve having a control line and a balance line in hydraulic communication therewith; wherein the control line and the balance line are also in latent hydraulic communication with an internal flow pathway within the nipple; and axially displacing a switching mechanism in the tubing string to transfer hydraulic communication of the control line and the balance line from the primary safety valve to an insert safety valve positioned in a bore of the nipple.

D. Methods for transferring hydraulic control from a primary safety valve to a secondary safety valve using a replaceable spool. The methods comprise: placing a tubing string comprising a nipple and a primary safety valve into a wellbore, the tubing string having an internal flow pathway and the primary safety valve being disposed in the tubing string above or below the nipple, the primary safety valve having a control line and a balance line in hydraulic communication therewith; wherein the control line and the balance line are also in latent hydraulic communication with a portion of the internal flow pathway within the nipple; and wherein hydraulic communication of the control line and the balance line with the primary safety valve is established with a first removable spool housed in a side pocket defined within the internal flow pathway; and replacing the first removable spool with a second removable spool; wherein hydraulic communication of the control line and the balance line is transferred to the nipple by the second removable spool.

Each of embodiments A-D may have one or more of the following additional elements in any combination:

Element 1: wherein the switching mechanism comprises one or more sliding sleeves.

Element 2: wherein axial displacement of a first sliding sleeve switches the control line and axial displacement of a second sliding sleeve switches the balance line.

Element 3: wherein the one or more sliding sleeves are axially displaceable by a wireline tool.

Element 4: wherein the one or more sliding sleeves are axially displaceable upon positioning of the insert safety valve in the bore of the nipple.

Element 5: wherein the switching mechanism comprises a sliding sleeve that engages a piston assembly upon axial displacement, the piston assembly also being axially displaced upon axial displacement of the sliding sleeve.

Element 6: wherein axial displacement of the sliding sleeve switches the control line and axial displacement of the piston assembly switches the balance line.

Element 7: wherein axial displacement of a single sliding sleeve switches both the control line and the balance line.

Element 8: wherein the switching mechanism is housed within a sub that is in latent hydraulic communication with the nipple.

Element 9: wherein a first switching mechanism switches the control line and a second switching mechanism switches the balance line.

Element 10: wherein the switching mechanism comprises a replaceable spool.

Element 11: wherein a single replaceable spool establishes hydraulic communication for both the control line and the balance line.

Element 12: wherein the side pocket is defined in a sub that is in latent hydraulic communication with the nipple.

Element 13: wherein the side pocket is defined in the bore of the nipple.

Element 14: wherein a first sliding sleeve is axially displaced to switch the control line and a second sliding sleeve is axially displaced to switch the balance line.

Element 15: wherein the method further comprises: positioning the insert safety valve in the bore of the nipple; wherein positioning the insert safety valve in the bore of the nipple axially displaces the one or more sliding sleeves.

Element 16: wherein the method further comprises: engaging a piston assembly with the sliding sleeve upon axial displacement thereof, and also axially displacing the piston assembly with the sliding sleeve; wherein axial displacement of the piston assembly transfers hydraulic communication of the balance line.

By way of non-limiting example, exemplary combinations applicable to A-D include:

The wellbore system of A in combination with elements 1 and 2; 1 and 3; 1 and 4; 1 and 5; 1, 5 and 6; 1 and 7; 1, 2 and 8; 1, 3 and 8; 1, 4 and 8; 1, 5 and 8; and 8 and 9.

The wellbore system of B in combination with elements 10 and 11; 10 and 12; 10, 11 and 12; and 12 and 13.

The method of C in combination with elements 1 and 14; 1 and 15; 1 and 16; 1 and 2; 1 and 4; 1 and 5; and 1 and 6.

The method of D in combination with elements 11 and 12; 11 and 13; and 12 and 13.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A wellbore system comprising:

a tubing string comprising a sub, a nipple and a primary safety valve, the primary safety valve being disposed in the tubing string above or below the nipple;

an upper portion of a control line and an upper portion of a balance line in hydraulic communication with the sub;

a lower portion of the control line and a lower portion of the balance line in hydraulic communication with the primary safety valve; and a switching mechanism, housed within the sub, axially displaceable to establish hydraulic communication between an insert safety valve positioned in a bore of the nipple and a latent control line and a latent balance line.

2. The wellbore system of claim 1, wherein the switching mechanism comprises one or more sliding sleeves.

3. The wellbore system of claim 2, wherein axial displacement of a first sliding sleeve switches the latent control line and axial displacement of a second sliding sleeve switches the latent balance line.

4. The wellbore system of claim 2, wherein the one or more sliding sleeves are axially displaceable by a wireline tool.

5. The wellbore system of claim 2, wherein the one or more sliding sleeves are axially displaceable upon positioning of the insert safety valve in the bore of the nipple.

6. The wellbore system of claim 2, wherein axial displacement of a single sliding sleeve switches both the latent control line and the latent balance line.

7. The wellbore system of claim 2, wherein the one or more sliding sleeves engages a piston assembly upon axial displacement, the piston assembly also being axially displaced upon axial displacement of the one or more sliding sleeves.

8. The wellbore system of claim 1, wherein a first switching mechanism switches the latent control line and a second switching mechanism switches the latent balance line.

9. A wellbore system comprising:

a tubing string comprising a nipple and a primary safety valve, the primary safety valve being disposed in the tubing string above or below the nipple;

a switching mechanism that is replaceable and is housed in a side pocket defined within an internal flow pathway of the tubing string; and a control line and a balance line in hydraulic communication with the primary safety valve and in latent hydraulic communication with a portion of the internal flow pathway within the nipple;

wherein the switching mechanism either establishes hydraulic communication between an upper and a lower portion of the control line and between an upper and a lower portion of the balance line, or between the bore of the nipple and the upper portions of the control line and the balance line.

10. The wellbore system of claim 9, wherein the switching mechanism comprises a replaceable spool.

11. The wellbore system of claim 10, wherein a single replaceable spool establishes hydraulic communication for both the control line and the balance line.

12. The wellbore system of claim 9, wherein the side pocket is defined in a sub that is in latent hydraulic communication with the nipple.

13. The wellbore system of claim 9, wherein the side pocket is defined in the bore of the nipple.

14. A method comprising:

placing a tubing string comprising a sub, a nipple and a primary safety valve into a wellbore, the primary safety valve being disposed in the tubing string above or below the nipple and the sub having an upper portion of a control line and an upper portion of a balance line in hydraulic communication therewith and the primary safety valve having a lower portion of the control line and a lower portion of the balance line in hydraulic communication therewith;

axially displacing a switching mechanism in the sub to establish hydraulic communication between an insert safety valve positioned in a bore of the nipple and a latent control line and a latent balance line.

15. The method of claim 14, wherein the switching mechanism comprises one or more sliding sleeves.

16. The method of claim 15, wherein a first sliding sleeve is axially displaced to switch the latent control line and a second sliding sleeve is axially displaced to switch the latent balance line.

17. The method of claim 15, further comprising:

positioning the insert safety valve in the bore of the nipple;

wherein positioning the insert safety valve in the bore of the nipple axially displaces the one or more sliding sleeves.

18. The method of claim 15, further comprising: engaging a piston assembly with the one or more sliding sleeves upon axial displacement thereof, and also axially displacing the piston assembly with the one or more sliding sleeves; wherein axial displacement of the piston assembly establishes hydraulic communication of the latent balance line.

19. The method of claim 14, further comprising: positioning the insert safety valve in the bore of the nipple; wherein positioning the insert safety valve in the bore of the nipple axially displaces a sliding sleeve.

20. The wellbore system of claim 7, wherein axial displacement of the one or more sliding sleeves switches the latent control line and axial displacement of the piston assembly switches the latent balance line.

* * * * *